US011744298B2

(12) United States Patent
McIntyre

(10) Patent No.: US 11,744,298 B2
(45) Date of Patent: Sep. 5, 2023

(54) ELECTRICALLY HEATED GARMENT WITH PASS-THROUGH BATTERY POCKET

(71) Applicant: MILWAUKEE ELECTRIC TOOL CORPORATION, Brookfield, WI (US)

(72) Inventor: Joseph R. McIntyre, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/541,888

(22) Filed: Dec. 3, 2021

(65) Prior Publication Data

US 2022/0175058 A1 Jun. 9, 2022

Related U.S. Application Data

(60) Provisional application No. 63/121,392, filed on Dec. 4, 2020.

(51) Int. Cl.

| | |
|---|---|
| ***A41D 13/005*** | (2006.01) |
| ***H05B 3/34*** | (2006.01) |
| ***H05B 3/36*** | (2006.01) |
| ***A41D 1/00*** | (2018.01) |

(52) U.S. Cl.

CPC ..... *A41D 13/0051* (2013.01); *A41D 1/005* (2013.01); *A41D 2400/10* (2013.01); *A41D 2400/12* (2013.01); *H05B 3/34* (2013.01); *H05B 2203/036* (2013.01)

(58) Field of Classification Search

None

See application file for complete search history.

(56) References Cited

U.S. PATENT DOCUMENTS

| | | | |
|---|---|---|---|
| 1,691,472 | A | 11/1928 | Graham et al. |
| 1,702,583 | A | 2/1929 | Williams |
| 2,150,251 | A | 3/1939 | Shanhouse |

(Continued)

FOREIGN PATENT DOCUMENTS

| | | | | |
|---|---|---|---|---|
| AT | 11613 | U1 * | 12/2010 | ..... A41D 13/0051 |
| CN | 1258201 | A | 6/2000 | |

(Continued)

OTHER PUBLICATIONS

AT-11613-U1, Feb. 2011, HV Corporate Concepts AG, partial translation. (Year: 2011).*

(Continued)

*Primary Examiner* — Joseph M. Pelham

(74) *Attorney, Agent, or Firm* — Michael Best & Friedrich LLP

(57) ABSTRACT

A heated article of clothing including a garment body, a heater coupled to the garment body, a heater supply cable configured to provide electrical power to the heater, and a battery pack configured to power to the heater by way of the heater supply cable. The garment body includes a first compartment configured to hold the battery pack, a second compartment configured to alternatively hold the battery pack, and a pass-through connecting the first compartment to the second compartment internally within the garment body such that the battery pack is movable between the first and second compartments while remaining coupled with the heater supply cable.

26 Claims, 30 Drawing Sheets

(56) References Cited

U.S. PATENT DOCUMENTS 2,156,504 A 5/1939 Liss
2,685,021 A 7/1954 Duncan
2,727,241 A 12/1955 Smith
3,084,241 A 4/1963 Carrona
3,177,341 A * 4/1965 De Woody ..... A47J 27/004 313/313
3,293,405 A 12/1966 Costanzo
3,392,264 A 7/1968 Arron
3,501,616 A 3/1970 Arron
3,663,796 A 5/1972 Hines et al.
3,748,436 A 7/1973 Cossaboom
3,953,935 A 5/1976 Reiner et al.
3,989,924 A 11/1976 Kurtzer
3,999,037 A 12/1976 Metcalf, Sr.
4,273,989 A 6/1981 Hinton et al.
4,279,255 A 7/1981 Hoffman
4,404,460 A 9/1983 Kerr
4,507,877 A 4/1985 Vaccari et al.
4,539,700 A 9/1985 Sato
4,589,134 A 5/1986 Waldron
4,645,325 A 2/1987 Inoue et al.
4,777,344 A 10/1988 Nash et al.
4,827,534 A 5/1989 Haugen
4,876,724 A 10/1989 Suzuki
4,985,934 A 1/1991 Perry
5,008,517 A 4/1991 Brekkstran et al.
5,032,705 A 7/1991 Batchellar et al.
5,101,515 A 4/1992 Holt et al.
5,105,067 A 4/1992 Brekkstran et al.
5,148,002 A 9/1992 Kuo et al.
5,158,039 A 10/1992 Clark
5,169,225 A 12/1992 Palm
5,230,333 A 7/1993 Yates et al.
5,302,806 A 4/1994 Simmons et al.
5,302,807 A 4/1994 Zhao
5,416,310 A 5/1995 Little
5,451,747 A 9/1995 Sullivan et al.
5,471,767 A 12/1995 Walker
5,499,401 A 3/1996 Heinmiller
5,603,646 A 2/1997 Tobias
5,605,144 A 2/1997 Simmons et al.
5,606,346 A 2/1997 Tobias
5,611,085 A 3/1997 Rasmussen
5,617,583 A 4/1997 Yates et al.
5,741,305 A 4/1998 Vincent et al.
5,777,296 A 7/1998 Bell
5,784,626 A 7/1998 Odaohara
5,826,273 A 10/1998 Eckes
5,866,881 A 2/1999 Jones, III
5,893,991 A 4/1999 Newell
5,953,758 A 9/1999 Foster
5,977,517 A 11/1999 Grosjean
6,049,062 A 4/2000 Jones
6,060,693 A 5/2000 Brown
6,078,025 A 6/2000 Yeung
D429,058 S 8/2000 Derosier
6,098,612 A 8/2000 Nakamoto et al.
6,155,841 A 12/2000 Spanyar
6,168,881 B1 1/2001 Fischer et al.
6,199,210 B1 3/2001 Feldman
6,232,674 B1 5/2001 Frey et al.
6,239,410 B1 5/2001 Tackore
6,319,015 B1 11/2001 Faunce
6,320,161 B1 11/2001 Hansen, Jr.
6,329,638 B1 12/2001 Bloodworth
6,333,570 B1 12/2001 Ilg
6,342,692 B1 1/2002 Hart et al.
6,350,129 B1 2/2002 Gorlick
6,439,942 B1 8/2002 Pillai et al.
6,450,168 B1 9/2002 Nguyen
6,519,779 B1 2/2003 Taguchi
6,550,471 B2 4/2003 Szymocha et al.
6,558,016 B1 5/2003 Restauro
6,561,814 B2 5/2003 Tilbury et al.
6,563,424 B1 5/2003 Kaario
6,598,235 B2 7/2003 Bulla
6,649,873 B1 * 11/2003 Cintron, Jr. ..... H05B 3/342 219/211
D487,426 S 3/2004 Johnson
6,792,124 B2 9/2004 Tilbury et al.
D498,037 S 11/2004 Bay
6,826,782 B2 12/2004 Jordan
6,854,988 B2 2/2005 Marmaropoulos et al.
6,888,111 B1 5/2005 Tobin
6,963,055 B2 11/2005 Rock et al.
7,210,939 B2 5/2007 Marmaropou et al.
7,230,206 B1 6/2007 Randall
7,375,308 B2 5/2008 Ferguson
7,448,874 B2 11/2008 Willis
7,462,035 B2 12/2008 Lee et al.
RE40,613 E 1/2009 Jordan
7,476,104 B2 1/2009 Marmaropoulos et al.
7,496,969 B2 3/2009 Pieczynski
7,559,768 B2 7/2009 Marmaropoulos et al.
7,560,664 B2 7/2009 Ford et al.
7,618,260 B2 11/2009 Daniel et al.
7,624,453 B2 12/2009 Rene et al.
7,651,016 B2 1/2010 Stewart
7,731,517 B2 6/2010 Lee et al.
7,739,748 B2 6/2010 Nilforushan et al.
7,753,685 B2 7/2010 Lee et al.
7,816,628 B2 10/2010 Fernandez et al.
7,816,632 B2 10/2010 Bourke, III et al.
D631,393 S 2/2011 Shani et al.
7,886,368 B2 2/2011 Hood
7,959,351 B1 6/2011 Thorpe
7,966,667 B2 6/2011 Tomlinson et al.
7,994,752 B2 8/2011 Soar
8,062,797 B2 11/2011 Fisher et al.
8,105,371 B1 1/2012 Giocondo, Jr.
8,107,653 B2 1/2012 Wolfe
8,144,911 B2 3/2012 Chiang et al.
8,157,570 B2 4/2012 Chen
8,251,157 B2 8/2012 Gray et al.
8,564,249 B2 10/2013 Lundqvist et al.
D729,690 S 5/2015 Rivirere
9,362,618 B2 * 6/2016 Alberth, Jr. ..... H01Q 1/526
D794,281 S 8/2017 Crowe et al.
D808,616 S 1/2018 Dorman
D866,487 S 11/2019 Dorman
2001/0047992 A1 12/2001 Deangelis et al.
2002/0076949 A1 6/2002 Tilbury et al.
2003/0074712 A1 4/2003 Liao
2004/0069761 A1 4/2004 Carr et al.
2004/0070996 A1 4/2004 Carr
2004/0237169 A1 12/2004 Wood et al.
2004/0256381 A1 12/2004 Haas et al.
2004/0257038 A1 12/2004 Johnson et al.
2005/0007406 A1 1/2005 Haas et al.
2005/0246826 A1 11/2005 McCarter et al.
2006/0001727 A1 1/2006 Haas et al.
2006/0060576 A1 3/2006 Haas et al.
2006/0128169 A1 6/2006 Marmaropoulos et al.
2006/0166520 A1 7/2006 Marmaropoulos et al.
2006/0213895 A1 9/2006 Dennis
2006/0227675 A1 10/2006 Fried
2007/0045269 A1 3/2007 Vassallo
2007/0118960 A1 5/2007 Goodwin
2007/0151593 A1 7/2007 Jaynes
2007/0287035 A1 12/2007 Marmaropoulos et al.
2008/0005825 A1 1/2008 Tronvold
2008/0023460 A1 1/2008 Huang
2008/0024438 A1 1/2008 Collins et al.
2008/0067163 A1 3/2008 Axinte et al.
2008/0083740 A1 4/2008 Kaiserman et al.
2008/0116189 A1 * 5/2008 Fernandez ..... H05B 3/342 219/211
2008/0184459 A1 8/2008 Barnes
2008/0223844 A1 9/2008 Cronn
2009/0014436 A1 1/2009 Toya et al.
2009/0032520 A1 2/2009 Cronn
2009/0094725 A1 4/2009 Smith et al.
2009/0158493 A1 6/2009 Kim
2009/0178173 A1 7/2009 Schultz

(56) References Cited

U.S. PATENT DOCUMENTS

| | | | | |
|---|---|---|---|---|
| 2009/0217440 | A1 | 9/2009 | Sutker | |
| 2009/0230112 | A1 | 9/2009 | Ducharme et al. | |
| 2009/0289046 | A1* | 11/2009 | Richmond | A41D 13/0051 429/61 |
| 2009/0310290 | A1 | 12/2009 | Tennent | |
| 2010/0031424 | A1 | 2/2010 | Sharpe et al. | |
| 2010/0100997 | A1 | 4/2010 | Lee et al. | |
| 2010/0115684 | A1 | 5/2010 | Freedman et al. | |
| 2010/0198043 | A1 | 8/2010 | Holzer et al. | |
| 2010/0263603 | A1 | 10/2010 | Baron | |
| 2010/0283295 | A1 | 11/2010 | Smith et al. | |
| 2010/0299800 | A1 | 12/2010 | Jackson | |
| 2011/0012552 | A1 | 1/2011 | Margalit | |
| 2011/0108538 | A1 | 5/2011 | Gray et al. | |
| 2011/0173731 | A1 | 7/2011 | McElroy et al. | |
| 2011/0185469 | A1 | 8/2011 | Santuccio et al. | |
| 2011/0260556 | A1 | 10/2011 | Partridge et al. | |
| 2011/0306218 | A1 | 12/2011 | Chen | |
| 2012/0060260 | A1 | 3/2012 | Kochling | |
| 2012/0062571 | A1 | 3/2012 | Malek | |
| 2012/0074128 | A1 | 3/2012 | Blackford et al. | |
| 2012/0091115 | A1 | 4/2012 | Mironichev et al. | |
| 2012/0298493 | A1 | 11/2012 | Hogan et al. | |
| 2013/0037531 | A1* | 2/2013 | Gray | A41D 13/0051 219/211 |
| 2013/0334194 | A1 | 12/2013 | Chen | |
| 2014/0246416 | A1 | 9/2014 | White | |
| 2014/0263264 | A1 | 9/2014 | Weir et al. | |
| 2015/0060430 | A1 | 3/2015 | Tsuge et al. | |
| 2015/0271873 | A1 | 9/2015 | Gray et al. | |
| 2015/0272236 | A1* | 10/2015 | Chen | H05B 3/342 219/211 |
| 2016/0037843 | A1* | 2/2016 | Cook | A41D 27/205 2/400 |
| 2016/0128393 | A1* | 5/2016 | Janda | A41D 13/0051 219/211 |
| 2017/0013889 | A1 | 1/2017 | Chen | |
| 2017/0332442 | A1 | 11/2017 | Strecker | |
| 2018/0146510 | A1 | 5/2018 | Gray et al. | |
| 2018/0242398 | A1 | 8/2018 | Gray et al. | |
| 2019/0150521 | A1* | 5/2019 | Pai | A41B 9/04 |
| 2019/0200739 | A1* | 7/2019 | Green Mullins | A41D 13/0012 |
| 2020/0254468 | A1* | 8/2020 | Kubota | C02F 1/02 |
| 2020/0276516 | A1* | 9/2020 | Imanaka | B01F 23/703 |
| 2020/0278111 | A1* | 9/2020 | Imanaka | F22B 1/287 |
| 2022/0385111 | A1* | 12/2022 | Truettner | A41D 1/002 |

FOREIGN PATENT DOCUMENTS

| | | | | |
|---|---|---|---|---|
| CN | 110101144 | A * | 8/2019 | |
| DE | 20012075 | U1 | 11/2000 | |
| DE | 20012530 | U1 | 11/2000 | |
| FI | 128676 | B * | 12/2019 | |
| FR | 2793116 | A1 | 11/2000 | |
| GB | 2158693 | A | 11/1985 | |
| JP | 6251757 | A | 9/1994 | |
| JP | 2000064112 | A | 2/2000 | |
| WO | 2012034416 | A1 | 3/2012 | |
| WO | WO-2016007385 | A1 * | 1/2016 | A41D 13/0058 |

OTHER PUBLICATIONS

International Search Report and Written Opinion for Application No. PCT/US2021/061795 dated Mar. 23, 2022 (8 pages).

"Convertible Heated Soft-shell Jacket", http://www.plusheat.com/by-brand/convertible-heated-soft-shell-jacket.html, pp. 1-20, 2010.

Heated Electric Jacket Battery 12V Compatible, http://www.electricblanket.net/p-96-heated-electric-jacket-battery-12-volt-compatable.aspx, pp. 1-4, 1999.

Series and Parallel Battery Configurations and Information, <https://batteryuniversity.com/index.php/learn/article/serial_and_parallel_battery_configurations>, Jun. 18, 2019 (3 pages).

Schmidt et al., "Modeling the Impact of Manufacturing Uncertainties on Lithium-Ion Batteries," Journal of The Electrochemical Society, 2020, vol. 167, 15 pages.

* cited by examiner

ELECTRICALLY HEATED GARMENT WITH PASS-THROUGH BATTERY POCKET

CROSS-REFERENCE TO RELATED APPLICATIONS

This application claims the benefit of U.S. Provisional Patent Appl. No. 63/121,392, filed Dec. 4, 2020, the content of which is incorporated fully herein by reference.

BACKGROUND

The present disclosure relates to garments, and in particular, to an electrically heated jacket for providing heat to a user wearing the jacket.

Garments, especially outwear such as jackets and parkas, may be insulated to protect a user from the cold. Insulated jackets rely on the user's own body heat to keep the user warm. If the insulation is too thin, the user may be cold. If the insulation is too thick, the user may overheat.

SUMMARY

In one aspect, the disclosure provides a heated article of clothing including a garment body, a heater coupled to the garment body, a heater supply cable configured to provide electrical power to the heater, a battery pack configured to power to the heater, and a battery holder electrically and mechanically coupleable with the battery pack and configured to provide the power from the battery pack to the heater by way of the heater supply cable. The garment body includes a first compartment disposed at least partially in a front of the garment body and configured to hold the battery pack and the battery holder, a second compartment disposed at least partially in a rear of the garment body and configured to alternatively hold the battery pack and the battery holder, and a pass-through connecting the first compartment to the second compartment internally within the garment body such that the battery pack is movable internally between the front and rear of the garment body while remaining coupled with the heater supply cable.

In another aspect, the disclosure provides a heated article of clothing including a garment body, a heater coupled to the garment body, a heater supply cable configured to provide electrical power to the heater, and a battery pack configured to power to the heater by way of the heater supply cable. The garment body includes a first compartment configured to hold the battery pack, a second compartment configured to alternatively hold the battery pack, and a pass-through connecting the first compartment to the second compartment internally within the garment body such that the battery pack is movable between the first and second compartments while remaining coupled with the heater supply cable.

In yet another aspect, the disclosure provides a heated article of clothing including a garment body, a heater coupled to the garment body, a heater supply cable configured to provide electrical power to the heater, and a battery pack configured to power to the heater by way of the heater supply cable. The garment body includes a first compartment configured to hold the battery pack, and a second compartment in communication with the first compartment and configured to alternatively hold the battery pack such that the battery pack is movable between the first and second compartments while remaining coupled with the heater supply cable.

Other aspects of the disclosure will become apparent by consideration of the detailed description and accompanying drawings.

DETAILED DESCRIPTION

Before any implementations of the disclosure are explained in detail, it is to be understood that the disclosure is not limited in its application to the details of construction and the arrangement of components set forth in the following description or illustrated in the following drawings. The disclosure is capable of other implementations and of being practiced or of being carried out in various ways.

Figure 1:
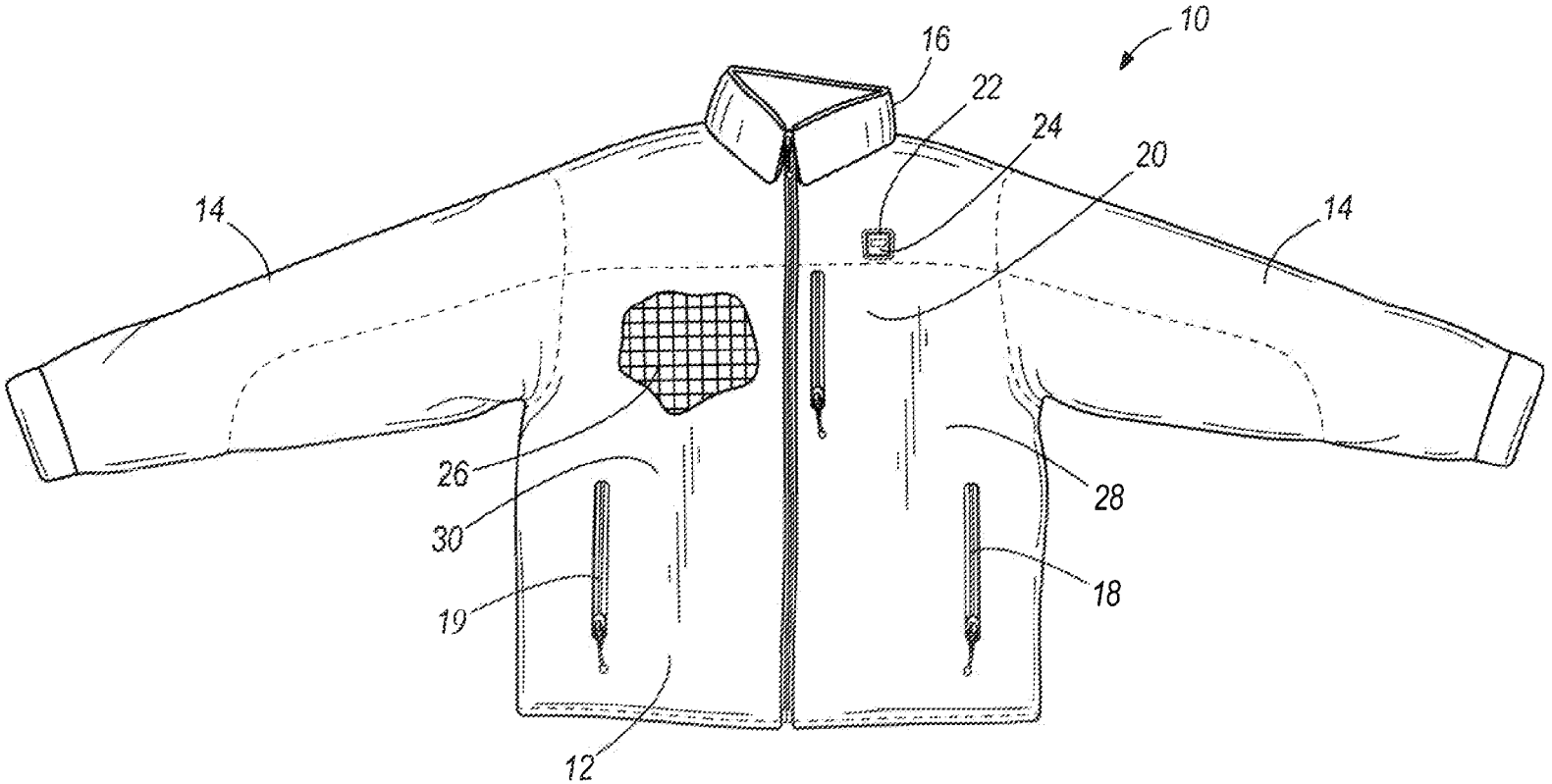
FIG. 1 is a front view of a jacket according to one implementation of the disclosure.

FIG. 1 illustrates a heated jacket 10 according to one implementation of the disclosure. The jacket 10 may be constructed in various sizes to fit a variety of users. The jacket 10 includes typical jacket features such as a torso body 12, arms 14, a collar 16, and a pocket 18 (e.g., configured for the wearer's left hand, though the pocket 18 may be configured for the wearer's right hand in other implementations). The jacket 10 may also include another pocket 19 for the other of the wearer's left or right hand. A front surface 20 of the jacket 10, defined by a front of the wearer, includes a control input. In the illustrated implementation, the control input is a button 22 that may be actuated by user. As explained in greater detail below, the button 22 includes a display portion 24 to indicate a status of the heated jacket 10. The pocket 18 is disposed on the front of the jacket 10 in the illustrated implementation; however, in other implementations, the pocket 18 may be disposed on any side of the jacket 10, such as the side, the back, etc.

Figure 2:
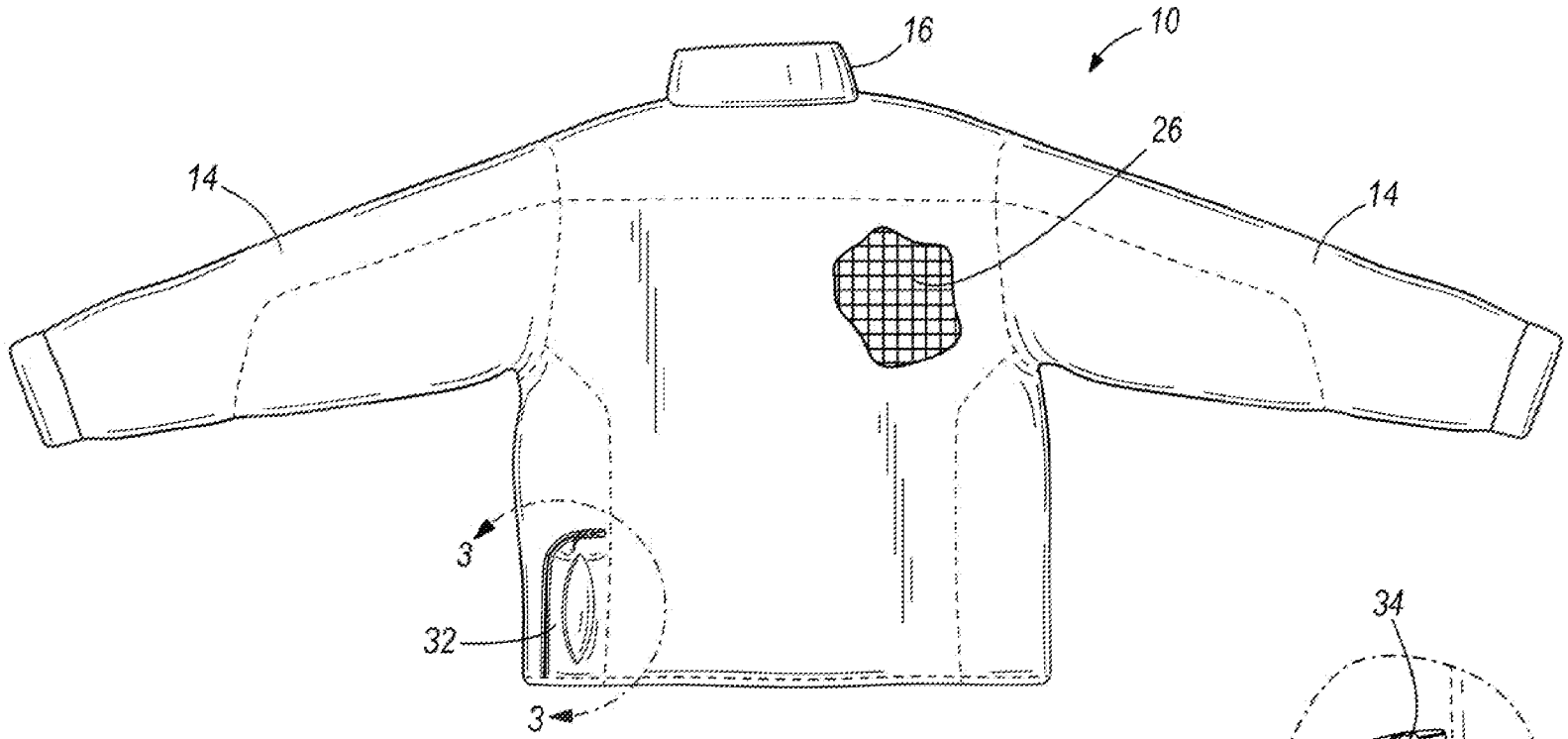
FIG. 2 is a rear view of the jacket of FIG. 1.

As illustrated in cutaway portions of FIGS. 1 and 2, the jacket 10 includes a heater array 26. The heater array 26 is disposed in both a left portion 28 and a right portion 30 of the torso body 12. In some implementations, the heater array 26 may extend into the arms 14 and/or collar 16. In other implementations the jacket may include a first heater array and second heater array arranged as an upper module and a lower module, respectively. In the illustrated implementation, the heater array 26 is controlled via the button 22 shown in FIG. 1. In other implementations, multiple heater arrays may be controlled individually via a single control input or multiple control inputs. The heating array 26 may include resistive heating coils formed of carbon fibers, high density carbon fibers, or other heating devices. The heated jacket 10 is capable of maintaining a temperature of up to 110 degrees Fahrenheit, although in further implementations lower or greater temperatures are possible depending upon the heat source.

Figure 3:
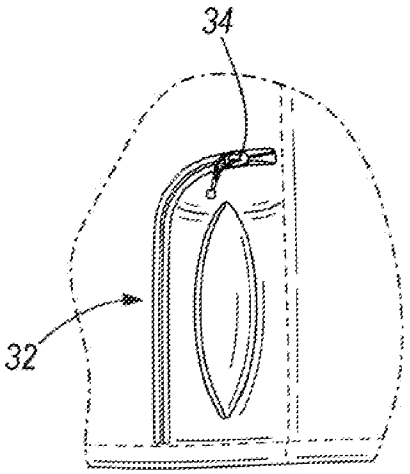
FIG. 3 is a detailed view of a rear compartment of the jacket of FIG. 2, and taken along line 3-3 of FIG. 2.
Figure 4:
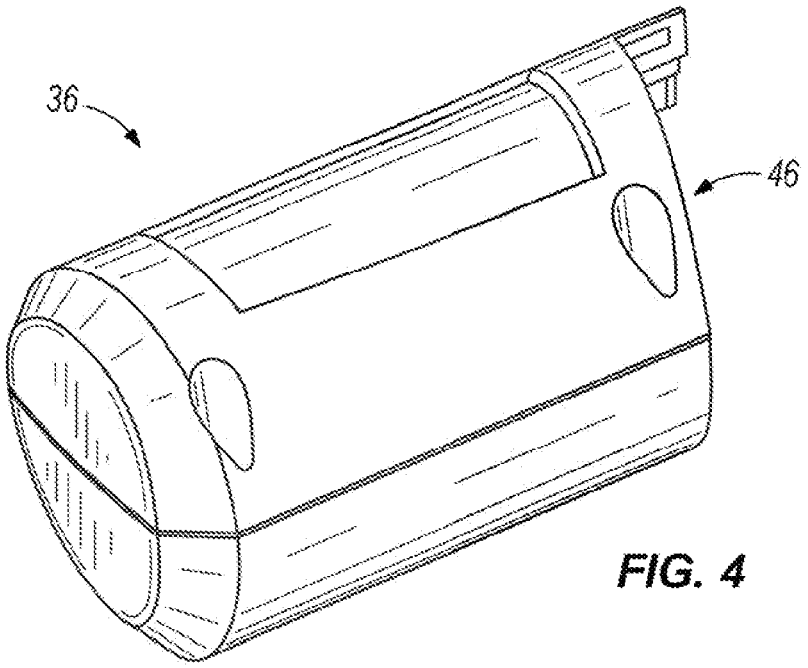
FIG. 4 is a perspective view of a battery holder according to one implementation of the disclosure.

As illustrated in FIG. 2, the heated jacket 10 includes a compartment 32 located on a lower portion of the back torso body. The compartment 32 houses an electrical component, such as a battery pack and battery holder. As illustrated in FIG. 3, the compartment 32 includes a zipper 34, providing selective access by a user to the compartment 32 in order to access the battery pack and other electrical components. FIG. 4 illustrates one example of a battery holder 36. The battery holder 36 is configured to receive a battery pack 38, such as the battery pack illustrated in FIG. 5.

Figure 5:
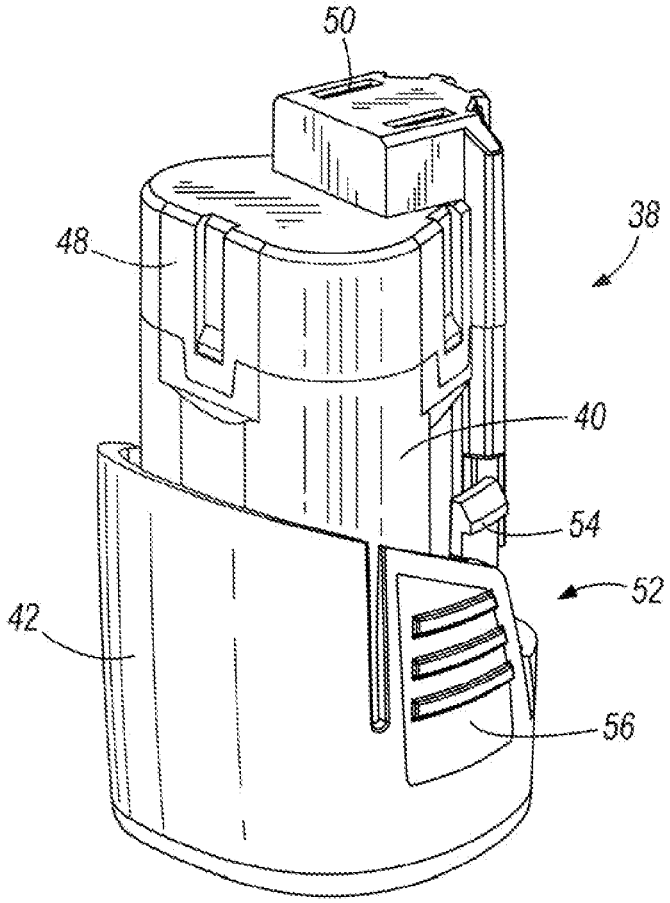
FIG. 5 is a perspective view of a battery pack for use with the battery holder of FIG. 4.
Figure 13:
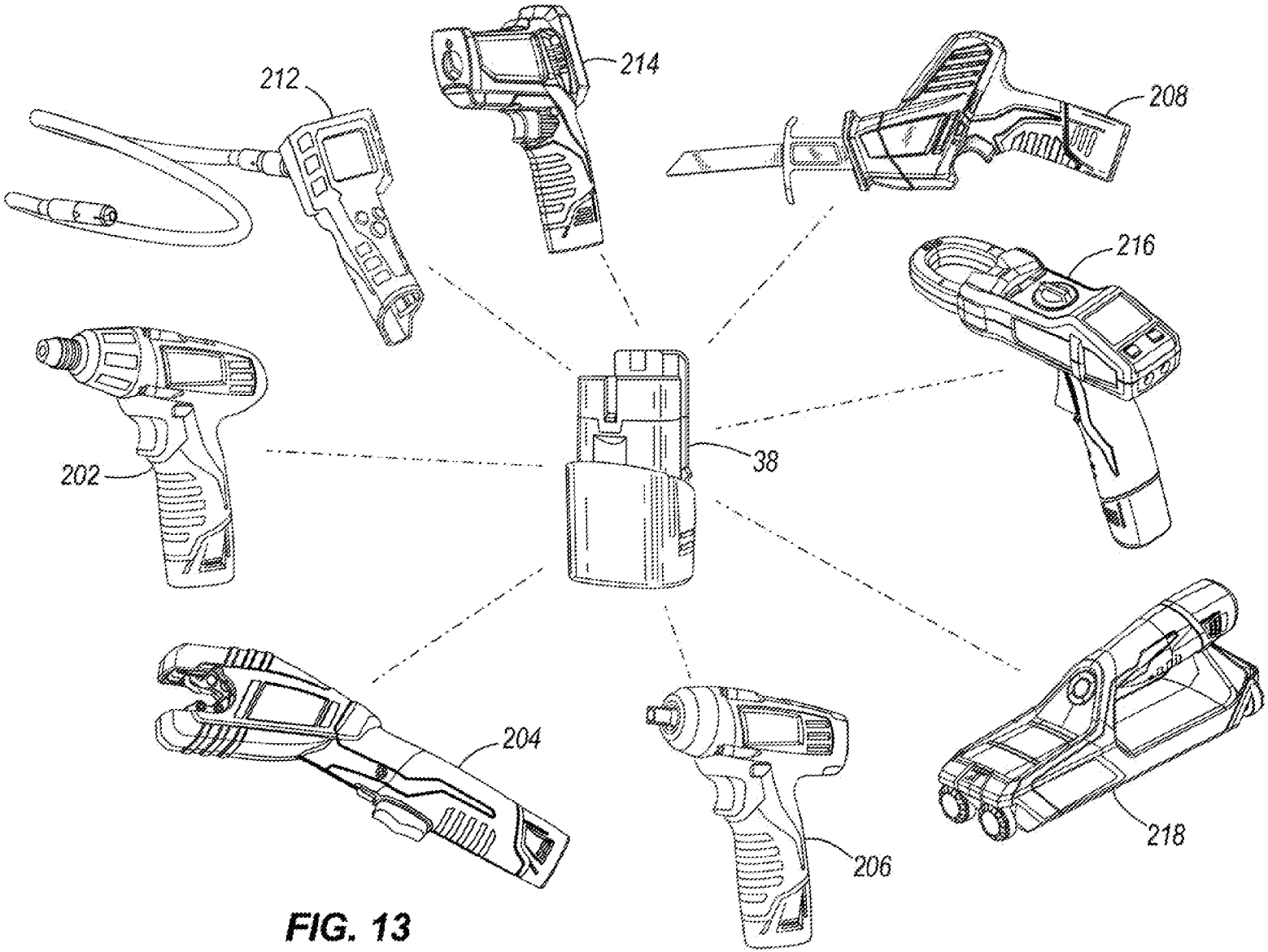
FIG. 13 is a perspective view of tools and devices usable with the battery pack of FIG. 5.

Referring to FIG. 5, the battery pack 38 is a lithium-based, rechargeable battery pack. The battery pack 38 is removably and interchangeably connected to the battery holder 36 to provide power to the jacket 10 during operation and to facilitate recharging of the battery pack 38 when not in use. In some implementations, the battery pack 38 may be used with other types of cordless, battery-powered tools or devices. FIG. 13, discussed below, illustrates exemplary tools and devices with which the battery pack 38 may be used. The battery pack 38 also may be used with other power tools or sensing devices not specifically discussed herein.

Figure 6:
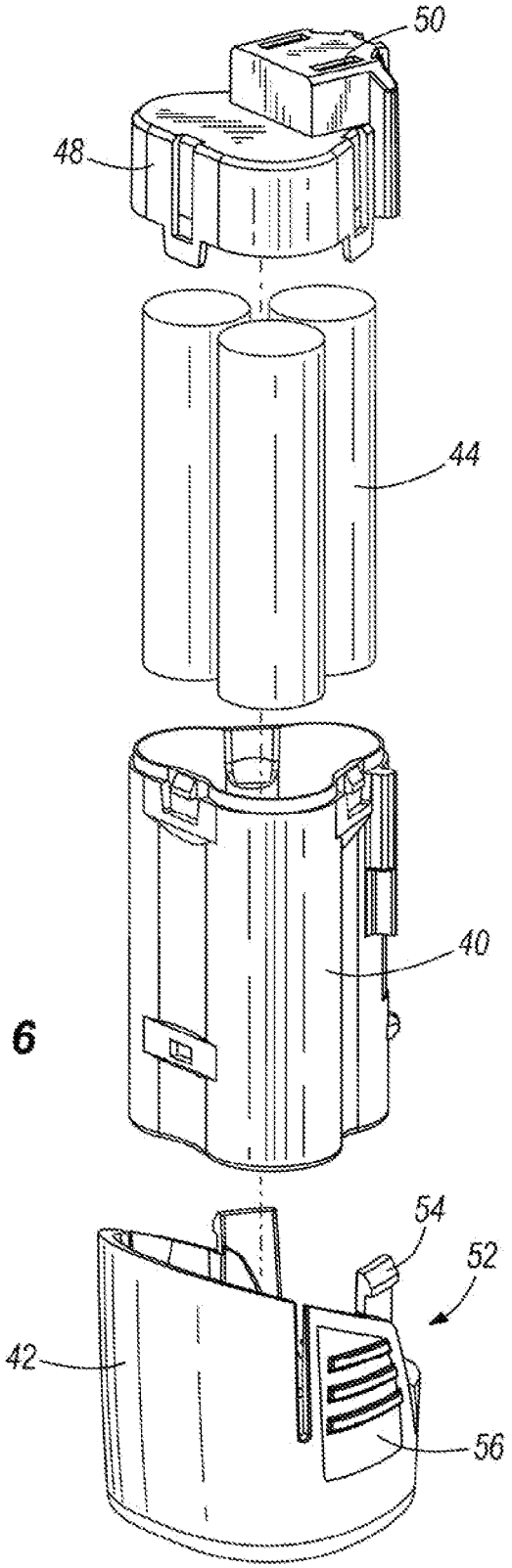
FIG. 6 is an exploded view of the battery pack of FIG. 5.

As illustrated in FIGS. 5 and 6, the battery pack 38 includes a casing 40, an outer housing 42 coupled to the casing 40, and a plurality of battery cells 44 positioned within the casing 40. The casing 40 is shaped and sized to fit within a cavity 46 of the battery holder 36 illustrated in FIG. 4, or alternatively, in a power tool or non-motorized sensing device to connect the battery pack 38 to the tool or device. The casing 40 includes an end cap 48 to substantially enclose the battery cells 44 within the casing 40. The illustrated end cap 48 includes two power terminals 50 configured to mate with corresponding power terminals 60 (FIG. 7) extending within the cavity 46 of the battery holder 36. In other implementations, the end cap 48 may also include sense or communication terminals that are configured to mate with corresponding terminals within the battery holder or a tool. The outer housing 42 includes a latching arrangement 52 for positively engaging the battery pack 38 with the battery holder 36. The latching arrangement 52 includes latching tabs 54 and resilient actuating portions 56. The latching tabs 54 are configured to engage corresponding recesses within the cavity 46 of the battery holder 36. The resilient actuating portions 56 are coupled to the latching tabs 54 and are configured for a user to selectively disengage the latching tabs 54 from the battery holder 36.

As shown in FIG. 6, the battery pack 38 includes three battery cells 44 positioned within the casing 40 and electrically coupled to the terminals 50. The battery cells provide operational power (e.g., DC power) to the jacket 10 or other device. In the illustrated implementation, the battery cells 44 are arranged in series, and each battery cell has a nominal voltage of approximately four-volts (4.0V), such that the battery pack 38 has a nominal voltage of approximately twelve-volts (12V). The cells 44 also have a capacity rating of approximately 1.4 Ah. In other implementations, the battery pack 38 may include more or fewer battery cells 44, and the cells 44 can be arranged in series, parallel, or a serial and parallel combination. For example, the battery pack 38 can include a total of six battery cells in a parallel arrangement of two sets of three series-connected cells. The series-parallel combination of battery cells creates a battery pack having a nominal voltage of approximately 12V and a capacity rating of approximately 2.8 Ah. In other implementations, the battery cells 44 may have different nominal voltages, such as, for example, 3.6V, 3.8V, 4.2V, etc., and/or may have different capacity ratings, such as, for example, 1.2 Ah, 1.3 Ah, 2.0 Ah, 2.4 Ah, 2.6 Ah, 3.0 Ah, etc. In other implementations, the battery pack 38 can have a different nominal voltage, such as, for example, 10.8V, 14.4V, etc. In the illustrated implementation, the battery cells 44 are lithium-ion battery cells having a chemistry of, for example, lithium-cobalt (Li—Co), lithium-manganese (Li—Mn), or Li—Mn spinel. In other implementations, the battery cells 44 may have other suitable lithium or lithium-based chemistries.

Figure 7:
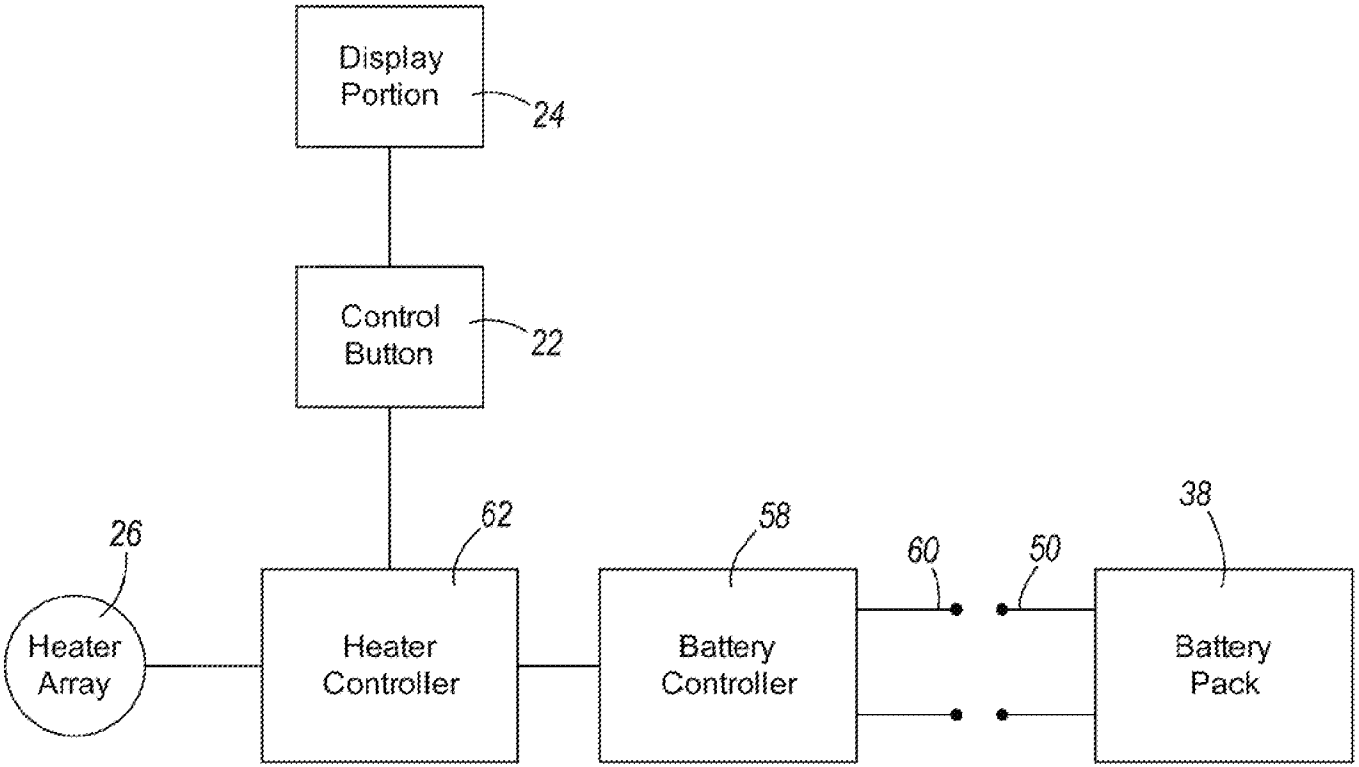
FIG. 7 is an electrical block diagram for the jacket of FIG. 1.

The heated jacket 10 includes control circuitry for the heater array 26 and battery pack 38. FIG. 7 is a block diagram of the heated jacket 10. A battery controller 58 receives electricity from the battery pack 38 via battery terminals 60 (disposed within the battery holder 36). The battery controller 58 may be configured to monitor a state of charge of the battery pack 38 and, if necessary, shutdown the heater array 26.

A heater controller 62 receives inputs from the control button 22 and selectively powers the heater array 26 depending upon the selected thermal output. The display portion 24 is selectively illuminated based upon the selected thermal output setting. The heater controller 62 may be configured to monitor a plurality of conditions of the jacket 10 including, but not limited to, an amount of current drawn by the heater array 26. The controllers 58, 62 are, for example, microprocessors, microcontrollers, or the like, and are configured to communicate with one another. In the illustrated implementation, the battery controller 58 provides information to the heater controller 62 related to a battery pack temperature or voltage level. The heater controller 62 and the battery controller 58 also include low voltage monitors and state-of-charge monitors. The monitors are used to determine whether the battery pack 38 is experiencing a low voltage condition, which may prevent proper operation of the heater array 26, or if the battery pack 38 is in a state-of-charge that makes the battery pack 38 susceptible to being damaged. If such a low voltage condition or state-of-charge exists, the heater array 26 is shut down or the battery pack 38 is otherwise prevented from further discharging current to prevent the battery pack from becoming further depleted.

The heated jacket 10 illustrated in FIGS. 1 and 2 may be operated as follows. To turn on the heated jacket 10, a user presses and holds the control button 22 for a first period (e.g., three seconds). When first turned on, the heater controller 62 causes the heated jacket 10 to enter pre-heat mode. The heated jacket 10 remains in a pre-heat mode for a period (e.g., five minutes) and then the heater controller 62 switches the heater array 26 to a medium thermal output setting. The user may adjust the thermal output setting by actuating the control button 22. Each press of the control button 22 will cycle the heater controller 62 through one of a sequence of thermal output settings (e.g., low, medium, high). In order to turn off the heated jacket 10 (or de-energize the heater array 26), the user presses and holds the control button 22 for a third period (e.g., three seconds).

As mentioned previously, the control button 22 includes an illuminated display portion 24 to indicate a status of the heaters. The display portion may be, for example, one or more LEDs. In the pre-heat mode, the display portion 24 flashes red. At a low thermal output setting, the display portion 24 glows blue. At a medium thermal output setting, the display portion 24 glows white. At a high thermal output setting, the display portion glows red. Other implementations may use various other colors or light patterns to indicate thermal output settings. Still other implementations may indicate a state of charge of the battery pack 38.

Figure 8:
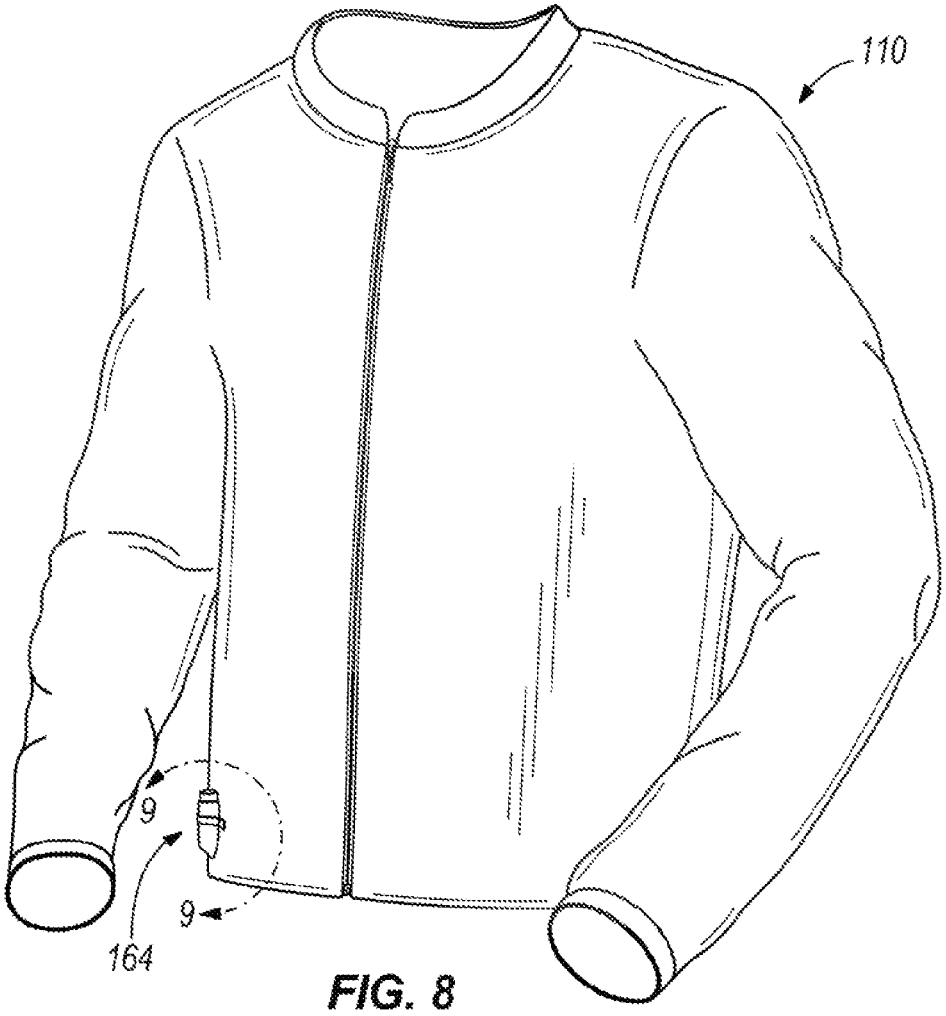
FIG. 8 is an image of a heated jacket including a heating module according to another implementation of the disclosure.
Figure 9:
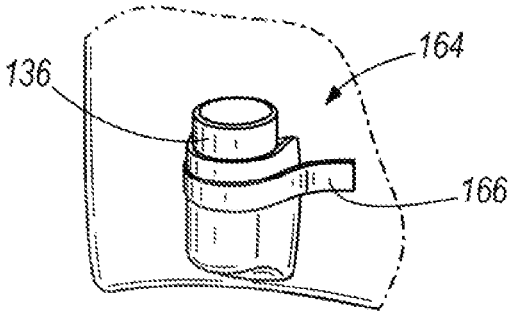
FIG. 9 is an enlarged view of the heated jacket including the heating module of FIG. 8.

FIG. 8 illustrates a heated jacket 110 according to another implementation of the disclosure. The heated jacket 110 may be constructed in various sizes to fit a variety of users. FIG. 9 is an enlarged view of a heating module 164, which is coupled to an outside surface of the jacket 110 by way of a strap 166. Alternatively, the heating module 164 may be coupled to an inner surface of the jacket 110 or disposed inside of an inner pocket of the jacket 110.

The heating module 164 includes a battery holder 136 (FIGS. 10 and 11) and a battery pack 38 (FIG. 5). The heating module 164 is electrically coupled to one or more heating coils (not shown) positioned within the jacket 110 to heat the jacket and provide heat to a user wearing the jacket. In the illustrated implementation, multiple heating coils are employed and positioned in various locations, or zones, within the jacket. For example, separate heating coils may be positioned in an upper torso area and a lower torso area, and may be separately controllable by the user. In further implementations, a single heating coil may be used, or the heating coils may be positioned at other locations within the jacket, (e.g., the back, arms, etc.).

Figure 10:
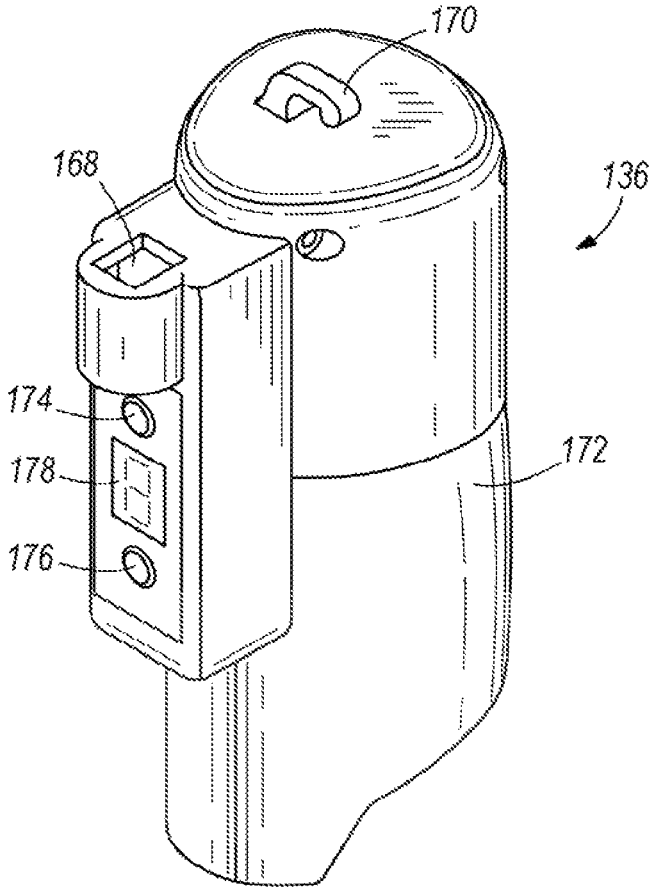
FIG. 10 is a top perspective view of a portion the heating module of FIG. 8.
Figure 11:
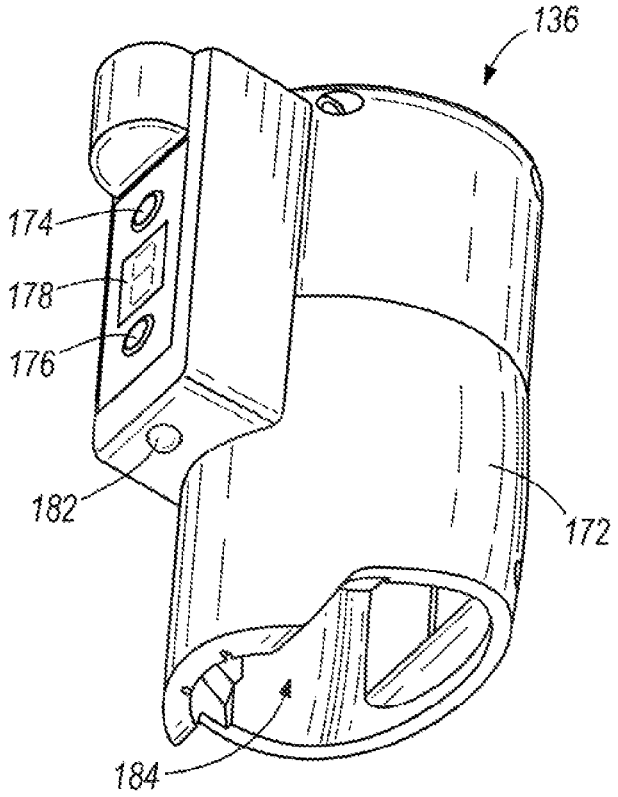
FIG. 11 is a bottom perspective view of the portion of the heating module of FIG. 10.

FIGS. 10 and 11 illustrate the battery holder 136 of the heating module 164 in greater detail. With reference to FIG. 11, the battery holder 136 includes an aperture 168 (e.g., an electrical port 168) for receiving an end of a cord (not shown), the cord being connected to the one or more heating coils and including a male connector terminal. A female connector (not shown) is positioned within the battery holder 136 adjacent the aperture 168 to receive the male connector and form an electrical connection between the heating coils and the battery pack 38. The battery holder 136 also includes a hook 170 for securing the cord disposed between the connector and the jacket 110.

Figure 12:
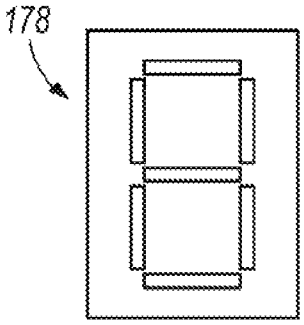
FIG. 12 is a front view of a display for positioning in an aperture of the heating module of FIG. 10.

With further reference to FIG. 10, the battery holder 136 includes a housing portion 172 for electrical components, including a circuit board (not shown). The housing portion 172 includes a first button 174, a second button 176 and a display 178. The first button 174 and the second button 176 are capable of communicating with the electrical components. In the illustrated implementation, the first button 174 is pressed by a user to increase the temperature of the heating coils, and the second button 176 is pressed by a user for lowering the temperature of the heating coils. In the illustrated implementation of FIG. 12, the display 178 is a seven segment display for representing a heating level indicative of the temperature of the heating coils.

With reference to FIG. 11, the battery holder 136 includes a power indicator 182, such as a light emitting diode (LED) that displays to the user when lit that the battery is connected, the heating coils are on, or the like. A portion of the battery holder 136 defines a battery cavity 184 for receiving the battery pack 38 (FIG. 5).

In other implementations, the battery holder 136 includes an on/off switch (such as the control button 22 discussed above), a fuel gauge that displays the amount of battery power remaining, and a user interface including heat zone controls to individually control the heating coils if multiple heating coils are employed.

FIG. 13 illustrates exemplary power tools and sensing devices with which the battery pack 38 may be usable. The battery pack 38 may be usable with power tools such as a drill 202, a pipe cutter 204, an impact driver 206, and a reciprocating saw 208. The battery pack 38 may also be usable with non-motorized sensing devices such as a visual inspection camera 212, an infrared sensor 214 (such as a thermometer or thermal imaging camera), a clamp-type multimeter 216, and a wall scanner 218 (such as a "stud finder").

Figure 14:
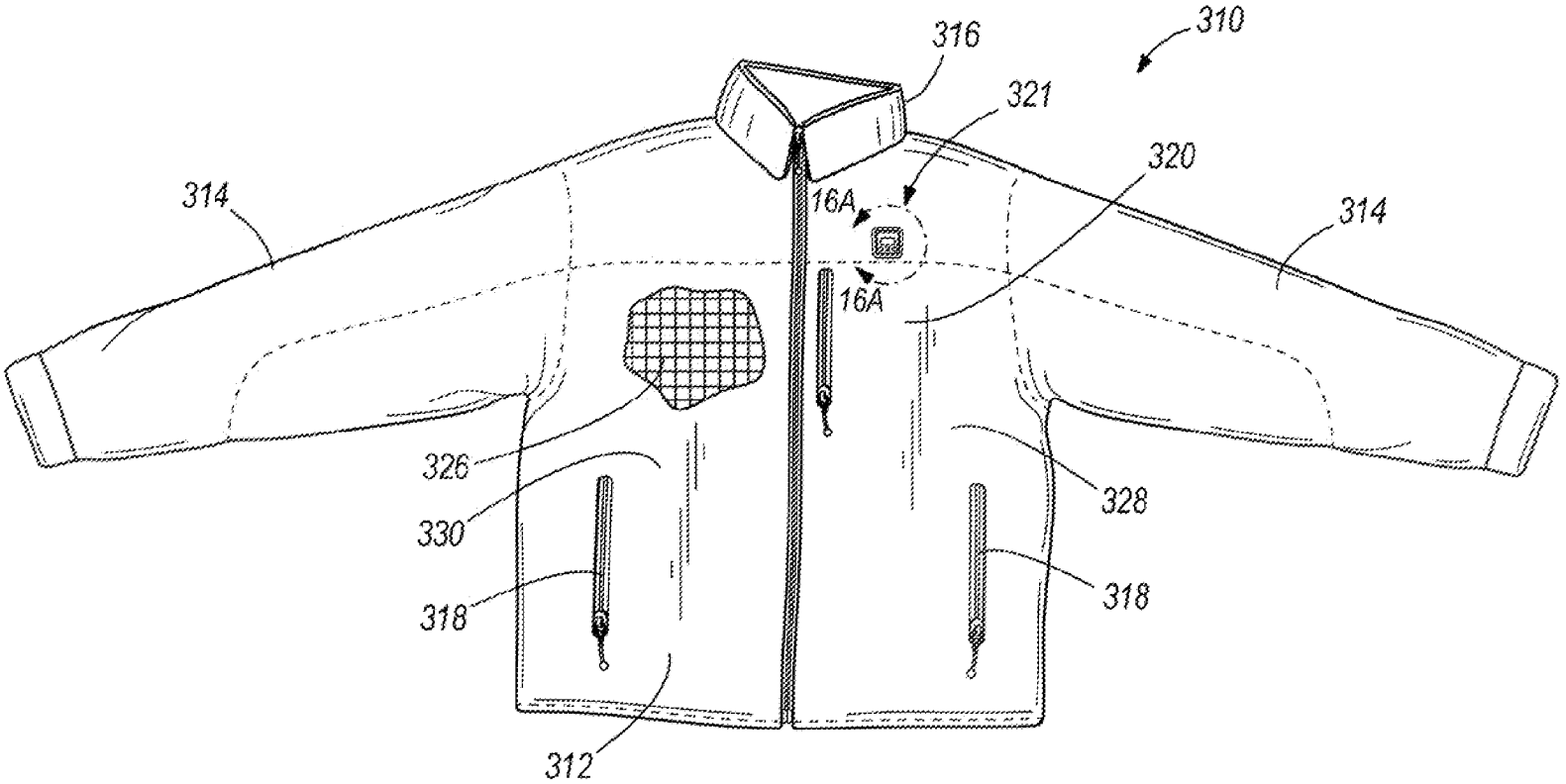
FIG. 14 is a front view of a jacket according to one implementation of the disclosure.
Figure 15:
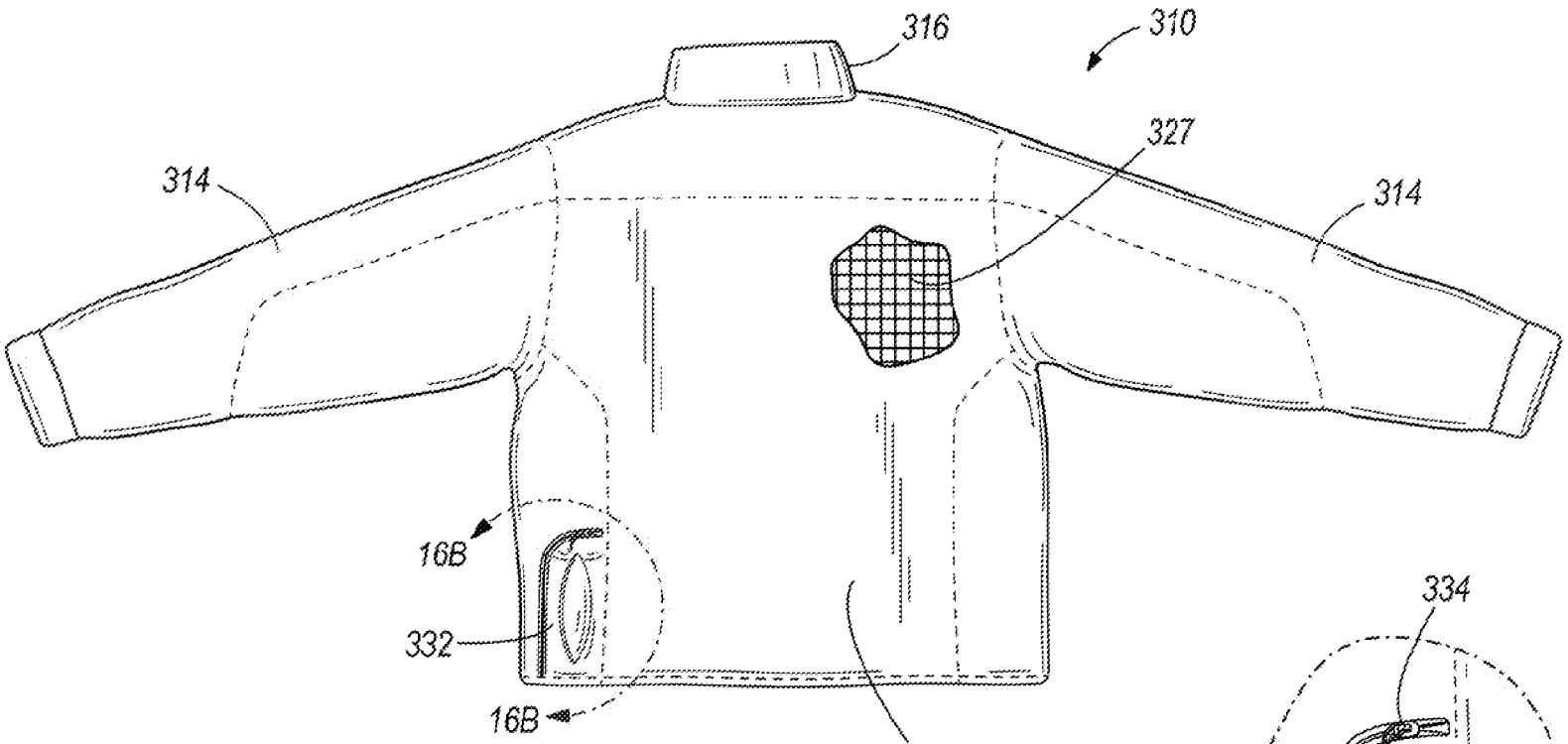
FIG. 15 is a rear view of the jacket of FIG. 14.
Figure 16B:
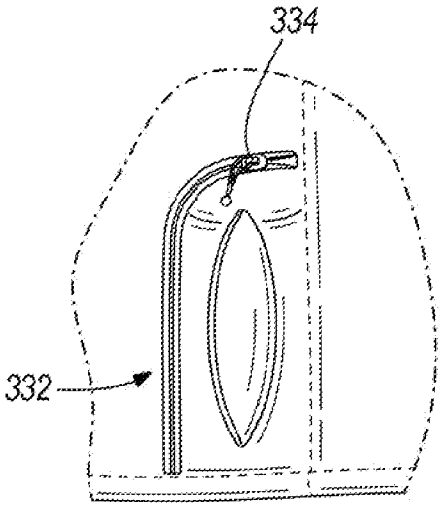
FIG. 16B is a detailed view of a rear compartment of the jacket of FIG. 15, and taken along line 16B-16B of FIG. 15
Figure 16A:
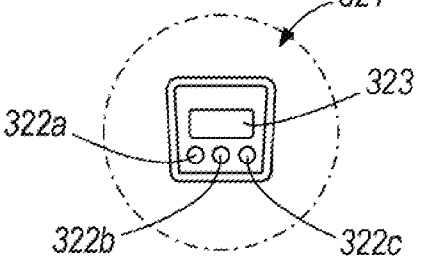
FIG. 16A is a detailed view of a control input of the jacket of FIG. 14, and taken along line 16A-16A of FIG. 14.

FIGS. 14 and 15 illustrate a heated jacket 310 according to one implementation of the disclosure. The jacket 310 may be constructed in various sizes to fit a variety of users. The heated jacket 310 is capable of maintaining a temperature of up to 110 degrees Fahrenheit, although in further implementations lower or greater temperatures are possible depending upon the heat source. The jacket 310 includes typical jacket features such as a torso body 312, arms 314, a back 315, a collar 316, and front pockets 318. The jacket 310 further includes a heating system having multiple heating zones. A front face 320 of the jacket 310 includes a control input 321 that is itself sealed or has a sealed connection to the jacket, such that the control input 321 is protected from environmental conditions. In the illustrated implementation, the control input 321 is configured to be actuated by a user to direct the control of the jacket heating system and heating zones. As illustrated in FIG. 16A and explained in greater detail below, the control input 321 includes three zone control buttons 322*a*, 322*b*, and 322*c* and an on/off button 323. Further, each of the zone control buttons 322*a*, 322*b*, 322*c* and the on/off button 323 include a display portion 324*a*, 324*b*, 324*c*, 324*d* (FIG. 20; e.g., a LED or other type of illumination embedded into each of the above buttons), respectively, to indicate the status of the jacket based on the inputs associated with pressing these buttons. In other implementations, the display portion 324 may be configured as a single display panel or display lights/illumination separate from the above buttons. Further, the control input 321 may be configured at different locations on the outside or the inside of the jacket, may be configured with different orientations for the buttons, and may be separated into multiple control inputs at different locations on the jacket.

As illustrated in cutaway portions of FIGS. 14 and 15, the jacket 310 includes a heating system made up of a first heater array 326 and a second heater array 327. The first heater array 326 is disposed in both a left portion 328 and a right portion 330 of the torso body 312. The second heater array 327 is disposed in the back 315. The heating system is further made up of a third heater array 329 (FIG. 20) disposed in the front pockets 318. The heating arrays may include resistive heating coils formed of carbon fibers, high density carbon fibers, or other heating devices. In other implementations, the heating system may include a fourth heater array (not shown) disposed in the arms 314 and/or a fifth heat array (not shown) disposed in the collar 16, and/or additional heater arrays, and may further have different configurations of the heater arrays, as the different heater arrays may be alternatively configured to extend into or be removed from other parts of the jacket 310.

Figure 17:
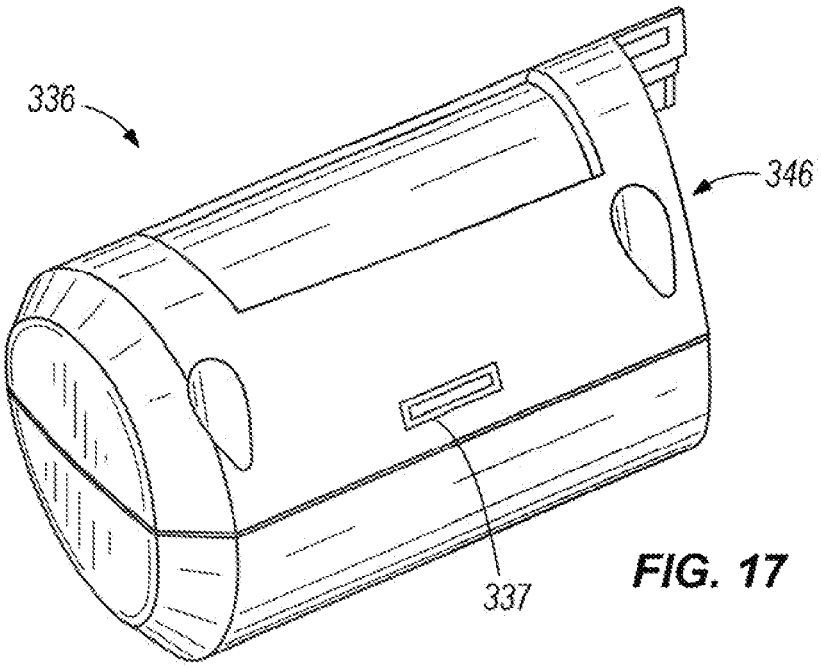
FIG. 17 is a perspective view of a battery holder according to one implementation of the disclosure.
Figure 26:
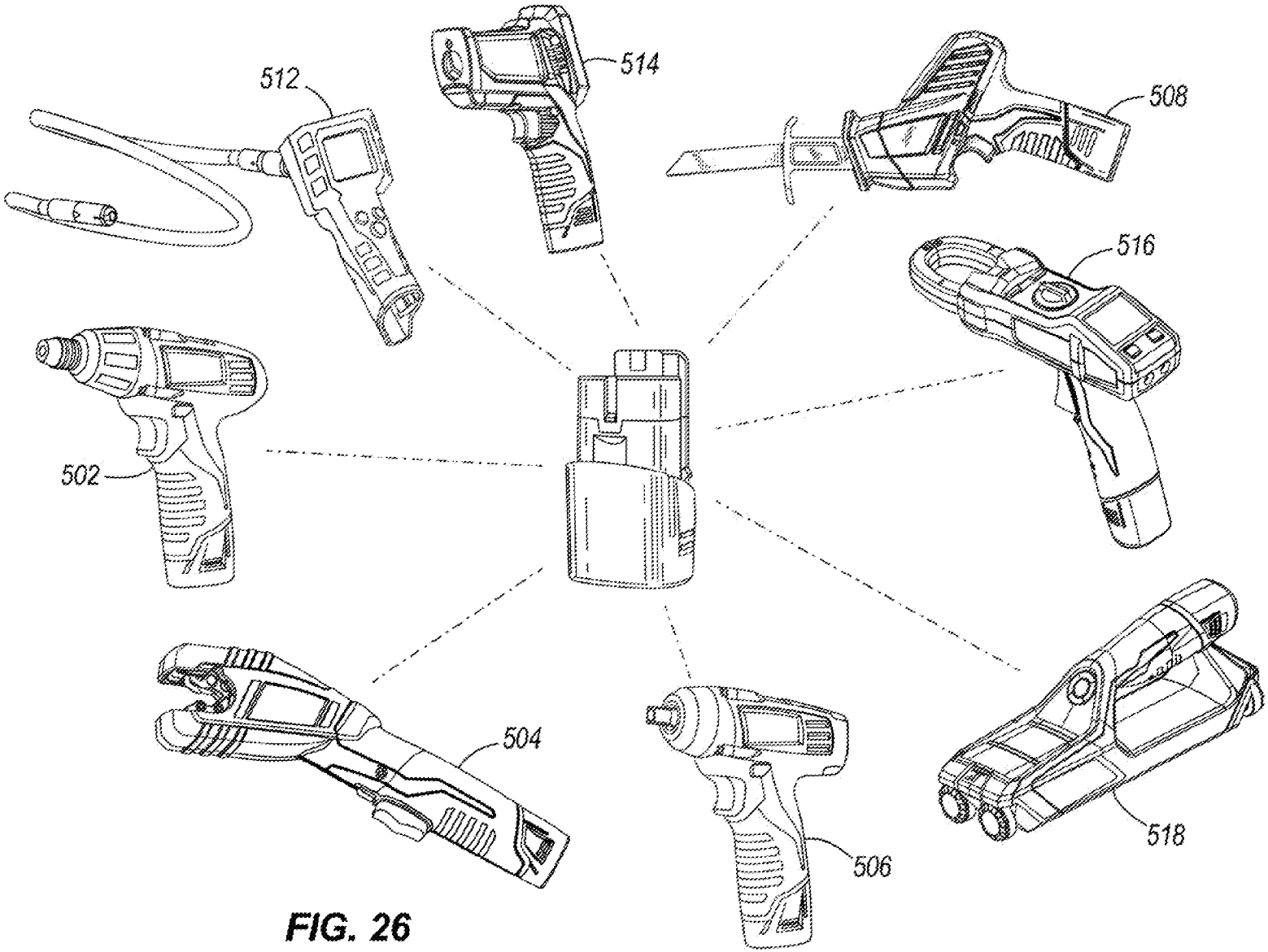
FIG. 26 is a perspective view of tools and devices usable with the battery pack of FIG. 18.

As illustrated in FIG. 15, the heated jacket 310 includes a compartment 332 located on a lower portion of the back torso body 315. The compartment 332 houses an electrical component, such as a battery pack 338 and a battery holder 336. As illustrated in FIG. 16B, the compartment 332 includes a zipper 334, providing selective access by a user to the compartment 332 in order to access the battery pack 338 and other electrical components. FIG. 17 illustrates one example of a battery holder 336. The battery holder 336 is configured to receive the battery pack 338, such as the battery pack 338 illustrated in FIG. 18. The battery holder 336 also includes a USB-type port 337 for communicating with and charging other devices, such as a digital media player, an iPOD®, or similar device Referring to FIG. 18, the battery pack 338 is a lithium-based, rechargeable battery pack. The battery pack 338 is removably and interchangeably connected to the battery holder 336 to provide power to the jacket 310 during operation and to facilitate recharging of the battery pack 338 when not in use. In some implementations, the battery pack 338 may be used with other types of cordless, battery-powered tools or devices. For example, the battery pack 338 may be usable with a drill, a PVC pipe cutter, an impact driver, and a metal pipe cutter, or other tools. The battery pack 338 may also be usable with a non-motorized sensing device such as a thermal imaging camera, a micro-inspection camera, a wall scanner, a digital multimeter, a thermometer, and a gas detector. A variety of such tools and devices are illustrated in FIG. 26. Furthermore, the battery pack 338 may be used with other power tools or sensing devices not specifically discussed herein.

Figure 18:
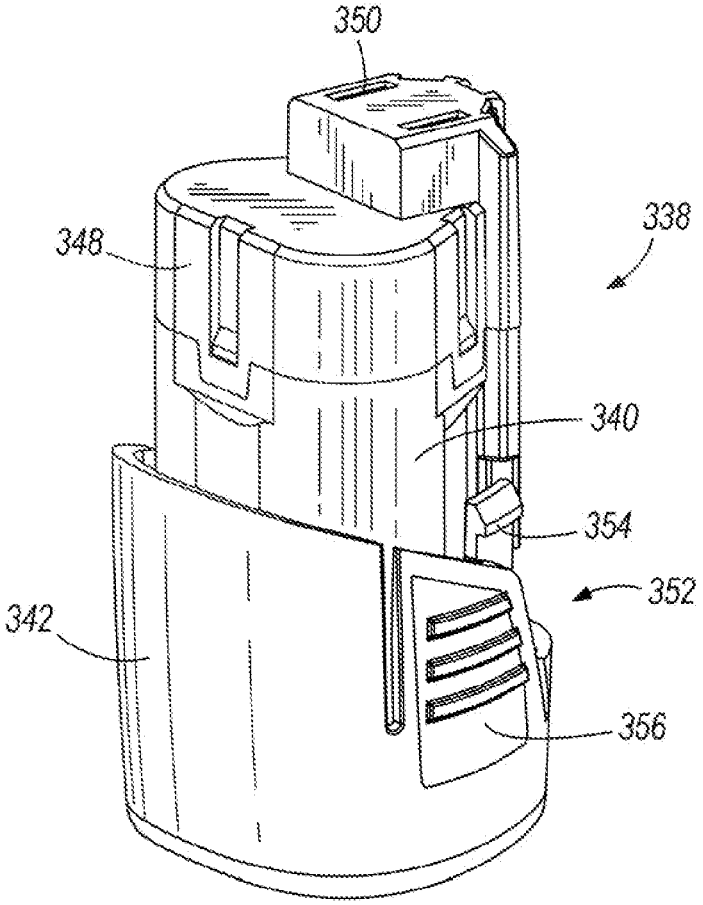
FIG. 18 is a perspective view of a battery pack for use with the battery holder of FIG. 17.
Figure 19:
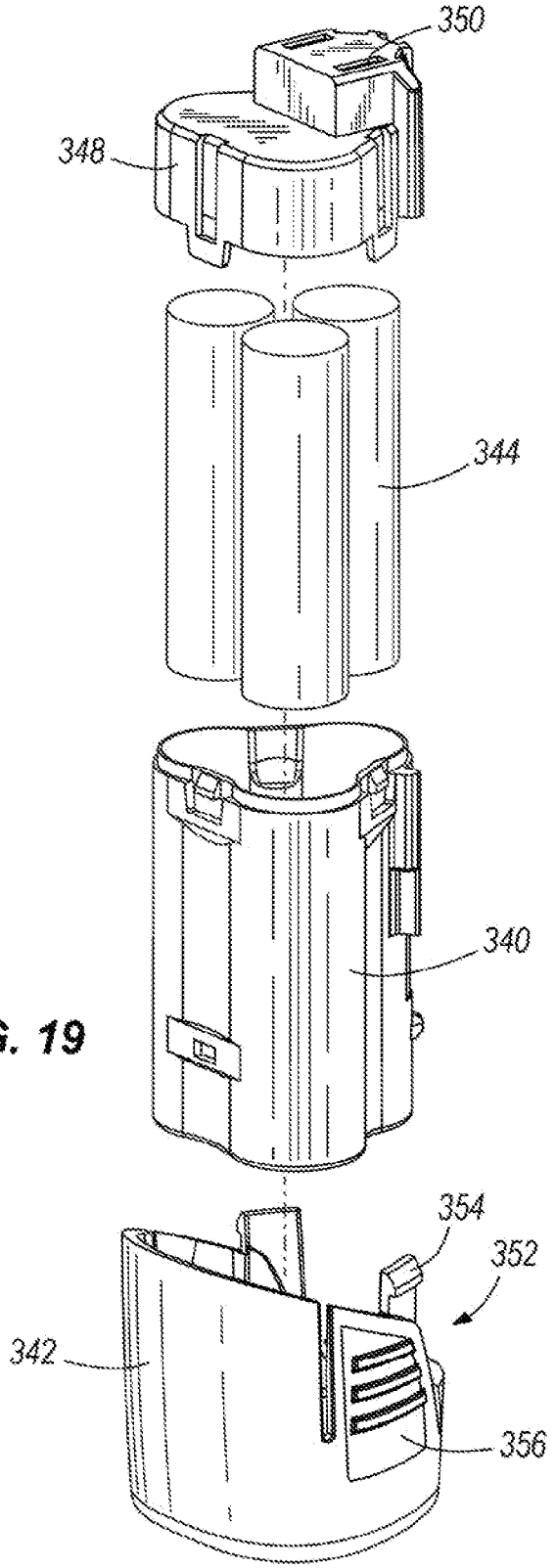
FIG. 19 is an exploded view of the battery pack of FIG. 18.

As illustrated in FIGS. 18 and 19, the battery pack 338 includes a casing 340, an outer housing 342 coupled to the casing 340, and a plurality of battery cells 344 positioned within the casing 340. The casing 340 is shaped and sized to fit within a cavity 346 of the battery holder 336 illustrated in FIG. 17, or alternatively, in a power tool or non-motorized sensing device to connect the battery pack 338 to the tool or device. The casing 340 includes an end cap 348 to substantially enclose the battery cells 344 within the casing 340. The illustrated end cap 348 includes two power terminals 350 configured to mate with corresponding power terminals 360 (FIG. 20) extending within the cavity 346 of the battery holder 336. In other implementations, the end cap 348 may also include sense or communication terminals that are configured to mate with corresponding terminals within the battery holder or a tool. The outer housing 342 includes a latching arrangement 352 for positively engaging the battery pack 338 with the battery holder 336. The latching arrangement 352 includes latching tabs 354 and resilient actuating portions 356. The latching tabs 354 are configured to engage corresponding recesses within the cavity 346 of the battery holder 336. The resilient actuating portions 356 are coupled to the latching tabs 354 and are configured for a user to selectively disengage the latching tabs 354 from the battery holder 336.

As shown in FIG. 19, the battery pack 338 includes three battery cells 344 positioned within the casing 340 and electrically coupled to the terminals 350. The battery cells provide operational power (e.g., DC power) to the jacket 310 or other device. In the illustrated implementation, the battery cells 344 are arranged in series, and each battery cell has a nominal voltage of approximately four-volts (4.0V), such that the battery pack 338 has a nominal voltage of approximately twelve-volts (12V). The cells 344 also have a capacity rating of approximately 1.4 Ah. In other implementations, the battery pack 338 may include more or fewer battery cells 344, and the cells 344 can be arranged in series, parallel, or a serial and parallel combination. For example, the battery pack 338 can include a total of six battery cells in a parallel arrangement of two sets of three series-connected cells. The series-parallel combination of battery cells creates a battery pack having a nominal voltage of approximately 12V and a capacity rating of approximately 2.8 Ah. In other implementations, the battery cells 344 may have different nominal voltages, such as, for example, 3.6V, 3.8V, 4.2V, etc., and/or may have different capacity ratings, such as, for example, 1.2 Ah, 1.3 Ah, 2.0 Ah, 2.4 Ah, 2.6 Ah, 3.0 Ah, etc. In other implementations, the battery pack 338 can have a different nominal voltage, such as, for example, 10.8V, 14.4V, etc. In the illustrated implementation, the battery cells 344 are lithium-ion battery cells having a chemistry of, for example, lithium-cobalt (Li—Co), lithium-manganese (Li—Mn), or Li—Mn spinel. In other implementations, the battery cells 344 may have other suitable lithium or lithium-based chemistries.

Figure 20:
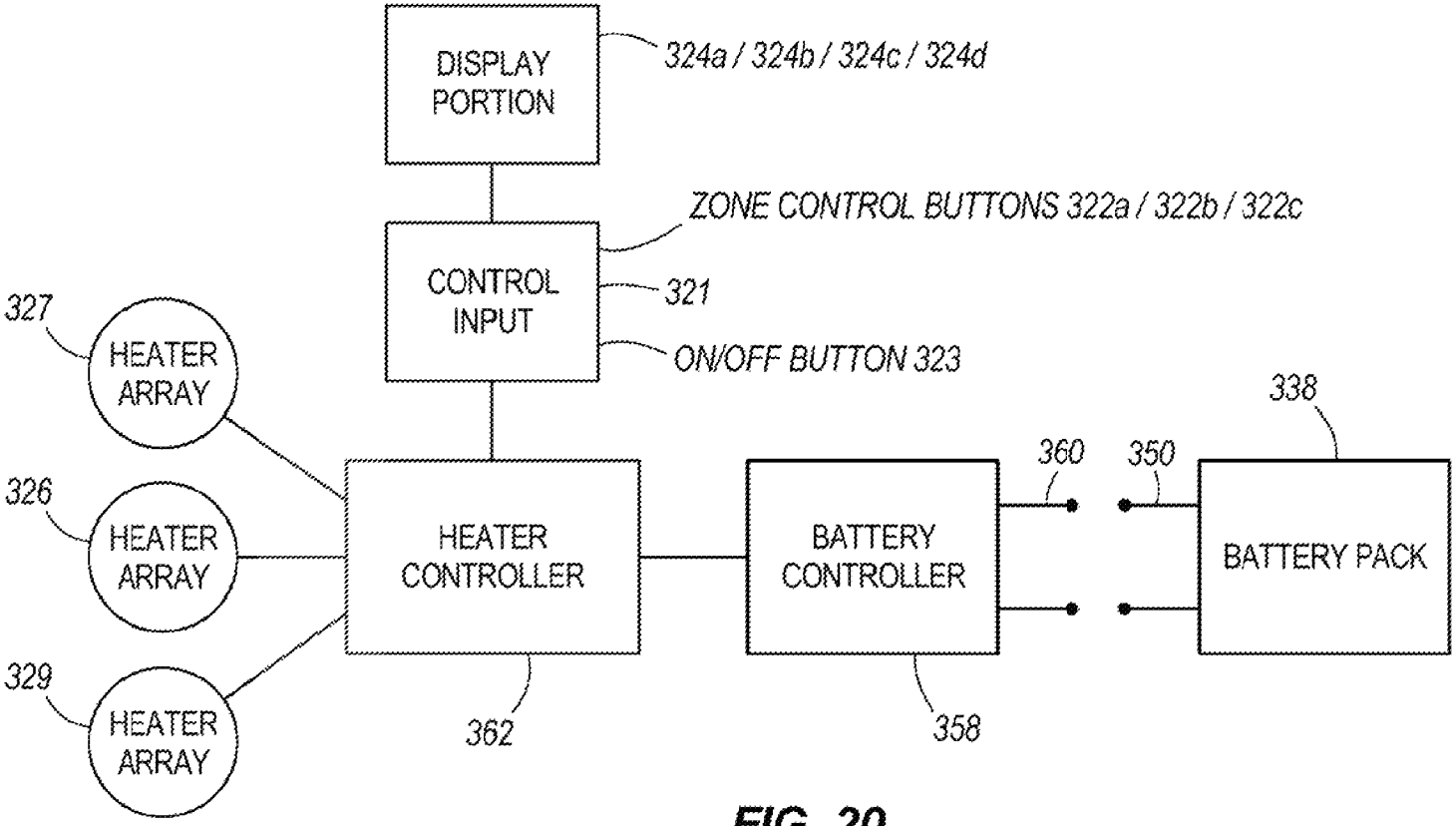
FIG. 20 is an electrical block diagram for the jacket of FIG. 14.

The heated jacket 310 includes control circuitry for the heating system having multiple heating zones. FIG. 20 is an electrical block diagram of the heated jacket 310. A battery controller 358 receives electricity from the battery pack 338 via battery terminals 360 (disposed within the battery holder 336). The battery controller 358 may be configured to monitor a state of charge of the battery pack 338 and, if necessary, shutdown the heater array 326.

As shown in FIG. 20, a heater controller 362 receives inputs from the control input 321 and selectively powers the heater arrays 326, 327, 329 depending upon a desired thermal output. The display portion 324*a*, 324*b*, 324*c*, 324*d*, associated with the particular control input button described above, is illuminated based upon the current status of that input button. The heater controller 362 may be configured to monitor a plurality of conditions of the jacket 310 including, but not limited to, an amount of current drawn by the heater arrays 326, 327, 329. The controllers 358, 362 are, for example, microprocessors, microcontrollers, or the like, and are configured to communicate with one another. In the illustrated implementation, the battery controller 358 provides information to the heater controller 362 related to a battery pack temperature or voltage level. The heater controller 362 and the battery controller 358 also include low voltage monitors and state-of-charge monitors. The monitors are used to determine whether the battery pack 338 is experiencing a low voltage condition, which may prevent proper operation of the heater arrays 326, 327, 329 or if the battery pack 338 is in a state-of-charge that makes the battery pack 338 susceptible to being damaged. If such a low voltage condition or state-of-charge exists, the heater arrays 326, 327, 329 are shut down or the battery pack 338 is otherwise prevented from further discharging current to prevent the battery pack from becoming further depleted.

In the illustrated implementation, the heating system and heating arrays 326, 327, 329 are configured to be actuated via the control input 321 (FIG. 14). The on/off button 323 is configured to turn the heating system on and off and also is configured to change thermal output setting of the heating system, including a high thermal output setting, a medium thermal output setting, and low thermal output setting. More specifically, the on/off button is configured to turn the heating system on after being pressed and held for a designated period of time (e.g., 1.5 seconds), such that all heating arrays 326, 327, 329 are turned on and automatically set to an initial predetermined thermal output setting. Subsequent presses of the on/off button change the thermal output setting according to sequence, such that the next press of the on/off button changes the heating system to the high thermal output setting. A further press of the on/off button changes the heating system to the medium thermal output setting. A further press of the on/off button changes the heating system to the low thermal output setting. A further press of the on/off changes the heating system back to the high thermal output setting to complete the sequence of high, medium, low, high, medium, low, and so on. The heating system is on, if any of the heating arrays 326, 327, 329 are on. The on/off button is configured to turn the heating system off after being pressed and held for designated period of time (e.g., 1.5 seconds). In other implementations, it is conceivable that the number of thermal output settings, the initial thermal output setting, and the sequence of thermal output settings could vary.

While the heating system is on, the zone control buttons 322*a*, 322*b*, 322*c* are each configured to turn a particular heater array on and off. More specifically, zone control button 322*a* is configured to turn the first heater array 326 on and off, zone control button 322*b* is configured to turn the second heater array 327 on and off, and zone control button 322*c* is configured to turn the third heater array 329 on and off. Subsequent presses of any one of the zone control buttons switches alternate the associated heating array between on and off. In other implementations, it is conceivable that multiple heater arrays may be controlled individually via a single control input button or multiple control input buttons.

The heated jacket 310 illustrated in FIGS. 14 and 15 may be operated as follows. To turn on the heated jacket 310, a user presses and holds the on/off button 323 for a designated period of time (e.g., 1.5 seconds). When first turned on, the heater controller 362 causes the heated jacket 310 to enter pre-heat mode. The heated jacket 310 remains in a pre-heat mode for a period (e.g., five minutes) and then the heater controller 362 switches the heater arrays 326, 327, 329 to a medium thermal output setting. The user may adjust the thermal output setting by actuating the on/off button 323, as discussed above. Each press of the on/off button 323 will cycle the heater controller 362 through one of a sequence of thermal output settings (e.g., high, medium, low). In order to turn off the heated jacket 10, the user presses and holds the on/off button for a designated period of time (e.g., 1.5 seconds).

As mentioned previously, the control input buttons 322*a*, 322*b*, 322*c*, 323 each include an illuminated display portion 324*a*, 324*b*, 324*c*, 324*d* to indicate a status of the heating system. As discussed above, the display portion may be, for example, one or more LEDs. The display portions 324*a*, 324*b*, 324*c* illuminate to indicate that their associated heating arrays are on. In the pre-heat mode, the display portion 324*d* on the on/off button 323 flashes red. At a low thermal output setting, the display portion 324*d* glows blue. At a medium thermal output setting, the display portion 324*d* glows white. At a high thermal output setting, the display portion 324*d* glows red. Other implementations may use various other colors or light patterns to indicate thermal output settings. Still other implementations may indicate a state of charge of the battery pack 338.

Various modifications of the control method or sequence are possible. For example, in other implementations, the user may select a desired temperature rather than a thermal output setting.

Figure 21:
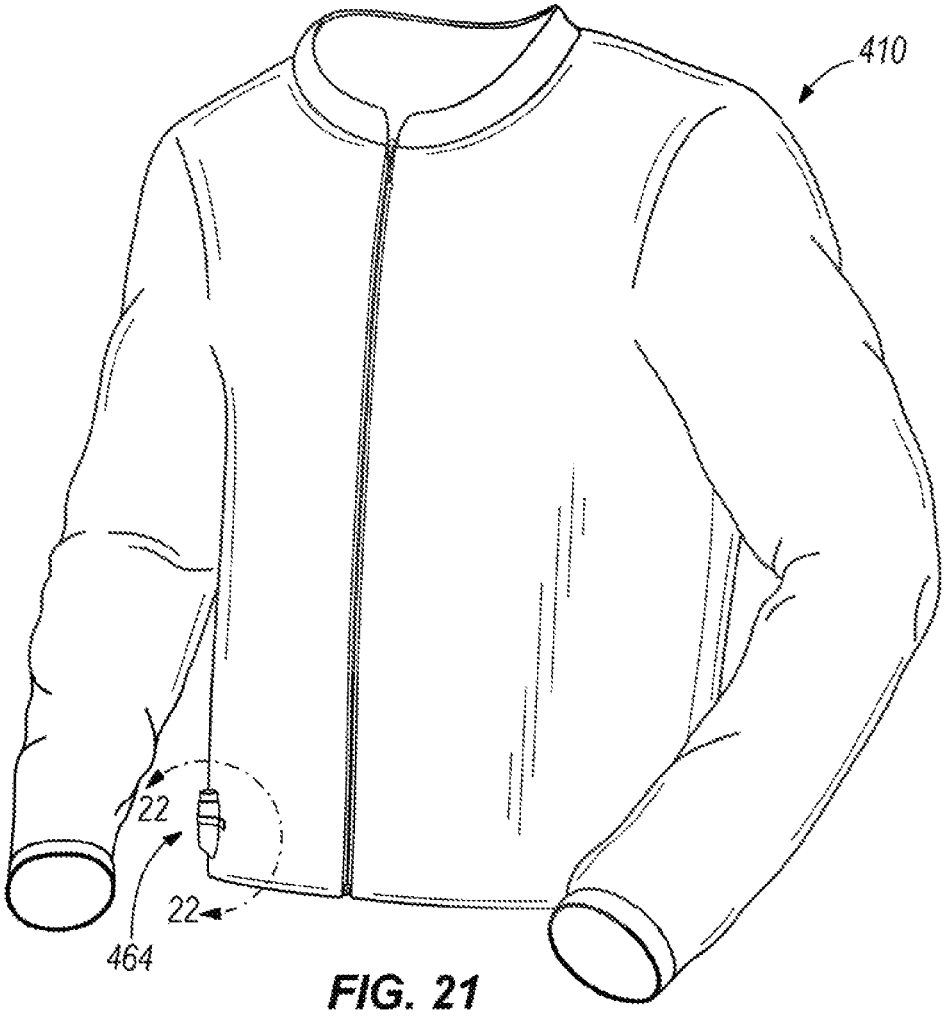
FIG. 21 is an image of a heated jacket including a heating module according to another implementation of the disclosure.
Figure 22:
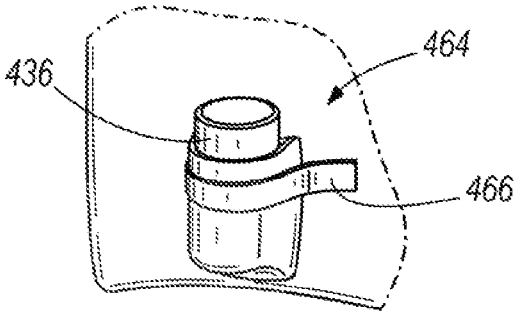
FIG. 22 is an enlarged view of the heated jacket including the heating module of FIG. 21.

FIG. 21 illustrates a heated jacket 410 according to another implementation of the disclosure. The heated jacket 410 may be constructed in various sizes to fit a variety of users. FIG. 22 is an enlarged view of a heating module 464, which is coupled to an outside surface of the jacket 410 by way of a strap 466. Alternatively, the heating module 464 may be coupled to an inner surface of the jacket 410 or disposed inside of an inner pocket of the jacket 410.

The heating module 464 includes a battery holder 436 (FIGS. 23 and 24) and a battery pack 338 (FIG. 18). The heating module 464 is electrically coupled to one or more heating coils (not shown) positioned within the jacket 410 to heat the jacket and provide heat to a user wearing the jacket. In the illustrated implementation, multiple heating coils are employed and positioned in various locations, or zones, within the jacket. For example, separate heating coils may be positioned in an upper torso area and a lower torso area, in a back area, and in front pockets, and may be separately controllable by the user. In further implementations, a single heating coil may be used, or the heating coils may be positioned at other locations within the jacket, (e.g., the back, arms, etc.).

Figure 23:
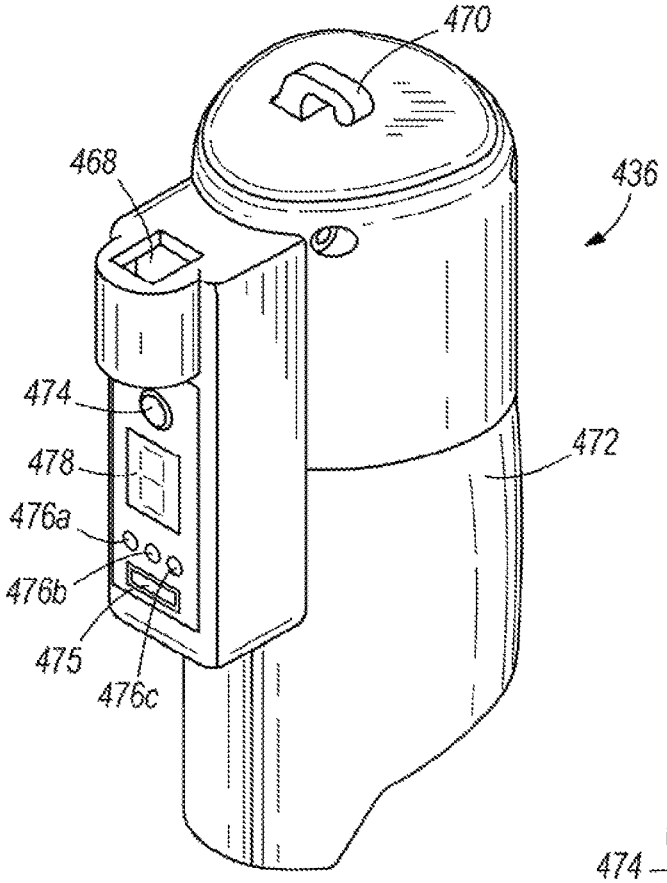
FIG. 23 is a top perspective view of a portion the heating module of FIG. 21.
Figure 24:
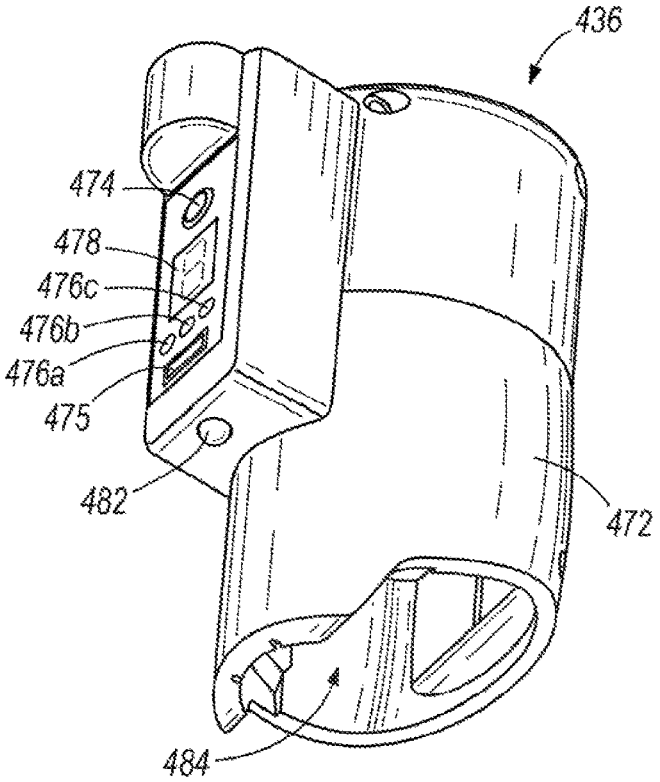
FIG. 24 is a bottom perspective view of the portion of the heating module of FIG. 23.

FIGS. 23 and 24 illustrate the battery holder 436 of the heating module 464 in greater detail. With reference to FIG. 23, the battery holder 436 includes an aperture 468 for receiving an end of a cord (not shown), the cord being connected to the one or more heating coils and including a male connector terminal. A female connector (not shown) is positioned within the battery holder 436 adjacent the aperture 468 to receive the male connector and form an electrical connection between the heating coils and the battery pack 338. The battery holder 436 also includes a hook 470 for securing the cord disposed between the connector and the jacket 410, and a USB port 475 for communicating with and charging other devices, such as a digital media player, an iPOD®, or similar device.

Figure 25:
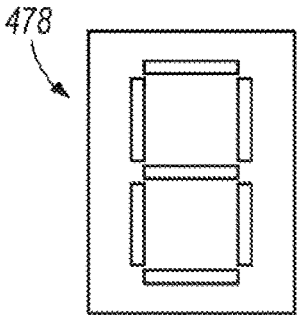
FIG. 25 is a front view of a display for positioning in an aperture of the heating module of FIG. 23.

With further reference to FIG. 23, the battery holder 436 includes a housing portion 472 for electrical components, including a circuit board (not shown). The housing portion 472 includes a first on/off button 474, three zone control buttons 476*a*, 476*b*, 476*c*, and a display 478. The first button 174 and the zone buttons 476*a*, 476*b*, 476*c* are capable of communicating with the electrical components. In the illustrated implementation, the on/off button 474 and zone control buttons 476*a*, 476*b*, 476*c* are configured and operate similarly to the above control input buttons 322*a*, 322*b*, 322*c*, 323. In the illustrated implementation of FIG. 25, the display 478 is a seven segment display for representing a heating level indicative of the temperature of the heating coils.

With reference to FIG. 24, the battery holder 436 includes a power indicator 482, such as a light emitting diode (LED) that displays to the user when lit that the battery is connected, the heating coils are on, or the like. A portion of the battery holder 436 defines a battery port 484 for receiving the battery pack 338 (FIG. 18). In other implementations, the battery holder 436 includes a fuel gauge that displays the amount of battery power remaining.

Figure 27:
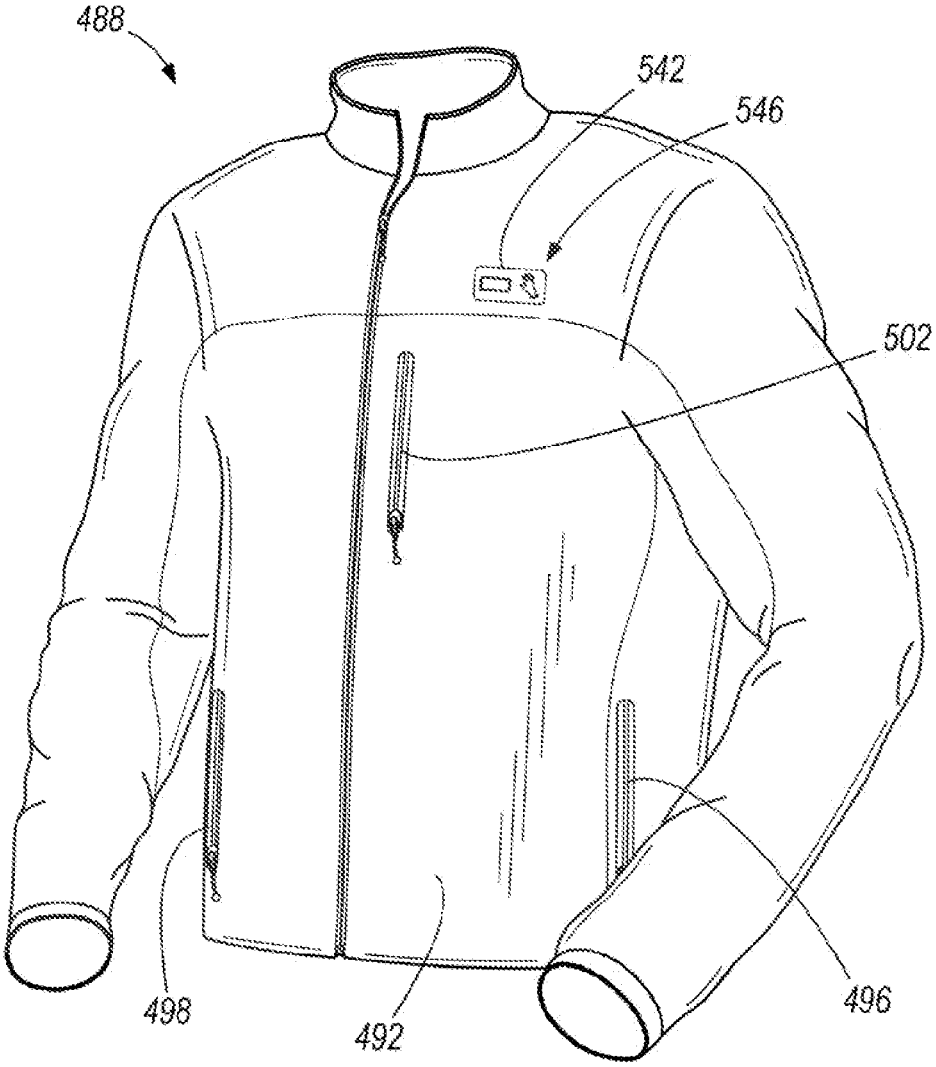
FIG. 27 is a perspective view of a jacket according to another implementation of the disclosure.
Figure 30:
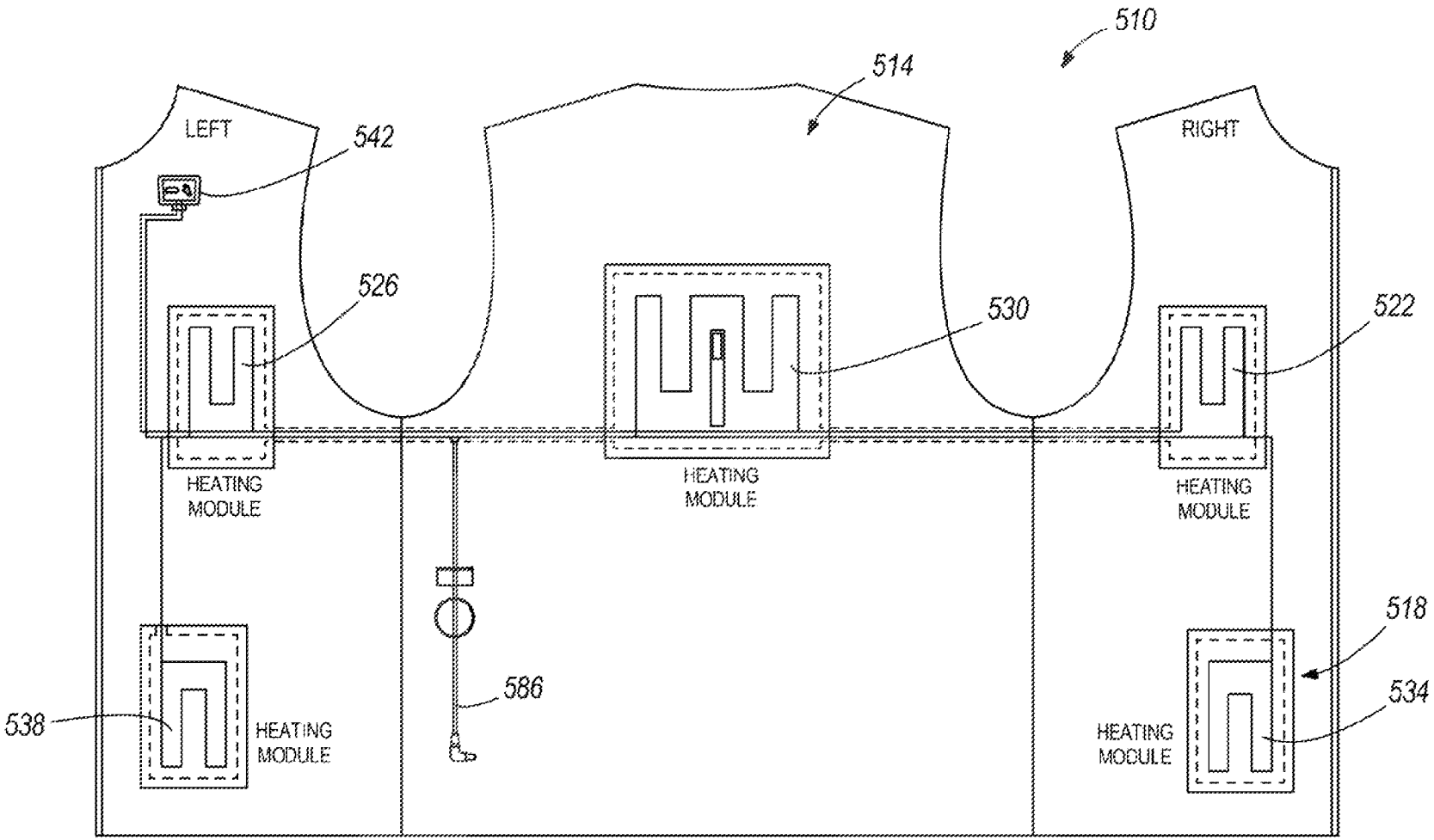
FIG. 30 is a circuit diagram for the jacket of FIG. 27.
Figure 38:
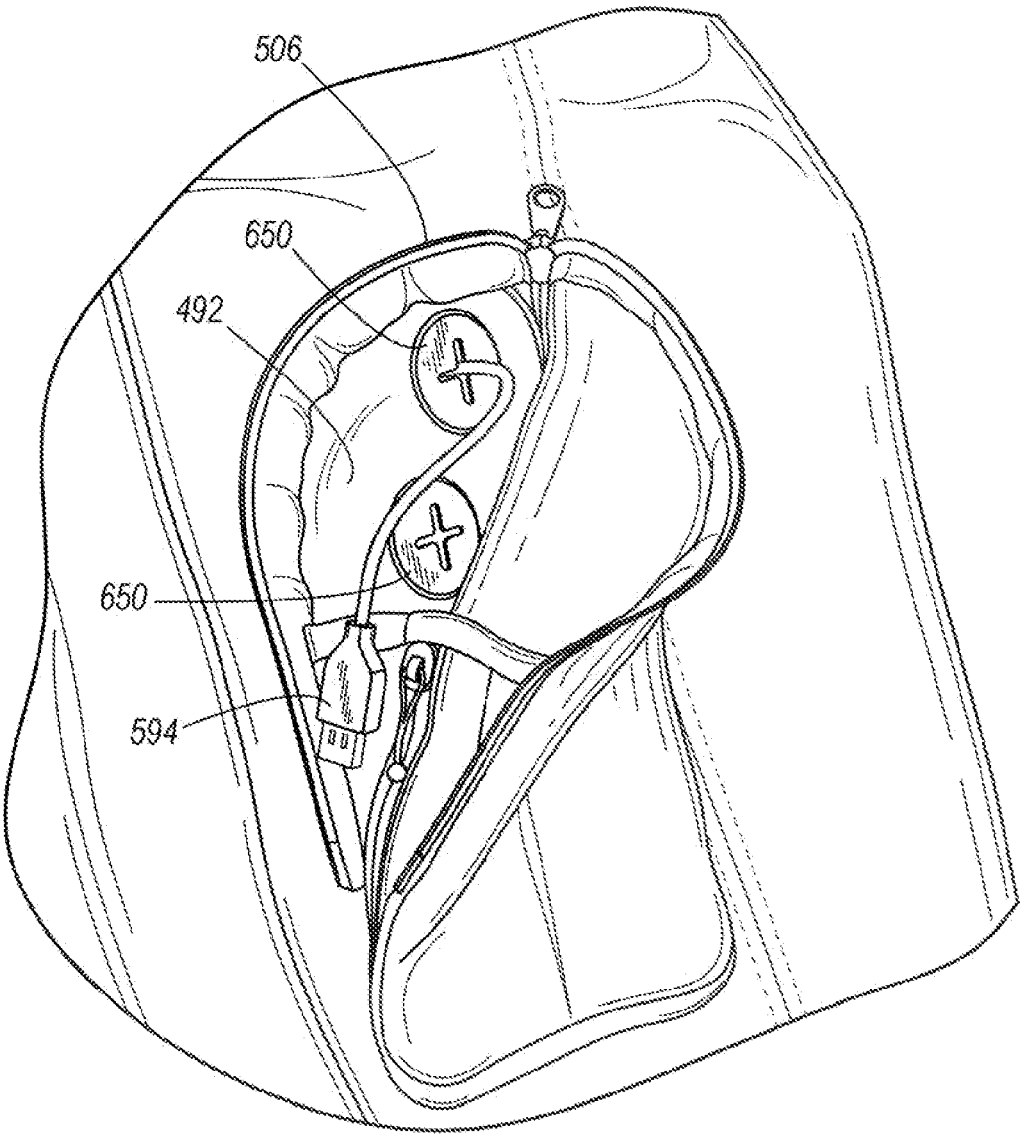
FIG. 38 illustrates a pocket, including wire routing features, of the jacket of FIG. 14.

FIG. 27 illustrates a heated jacket 488 according to another implementation of the disclosure. The jacket 188 includes an outer shell 492 with left and right front pockets 496 and 498, and a chest pocket 502. FIG. 38 illustrates a rear compartment 506 of the jacket 488. Referring to FIG. 30, the heated jacket 488 includes a heating system 510 including a core heater array 514 and a pocket heater array 518. The core heater array 514 includes a right chest heating module 522, a left chest heating module 526, and a back heating module 530. The pocket heater array 518 includes a right pocket heating module 534 and a left pocket heating module 538. The heater arrays 514 and 518 may include resistive heating coils formed of carbon fibers, high density carbon fibers, or other heating devices.

Figure 28:
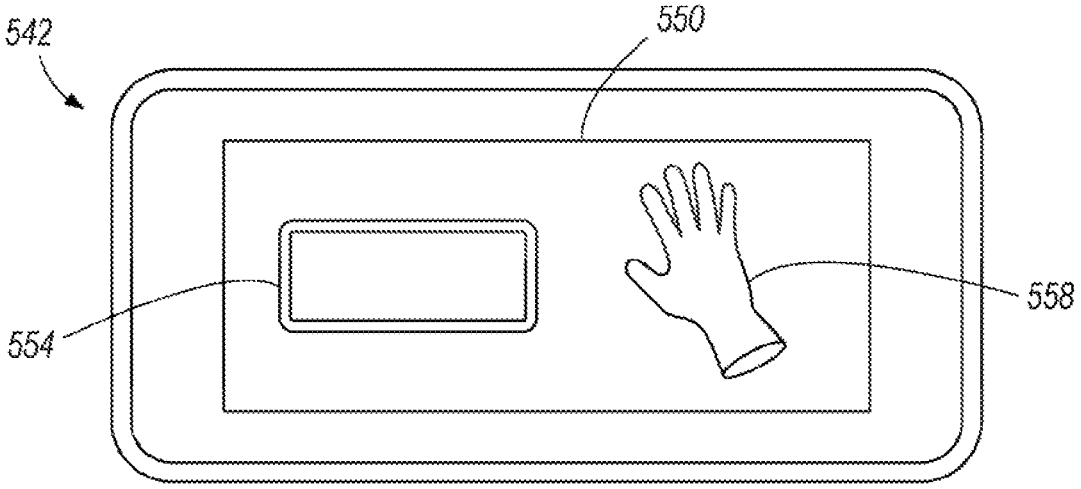
FIG. 28 is a front view of a control input of the jacket of FIG. 27.

The core heater array 514 and pocket heater array 518 are controlled via a heater control module 542. The heater control module 542 is coupled to a chest portion 546 of the jacket 488 (FIG. 27). Referring to FIG. 28 an external surface 550 of the heater control module 542 provides access to a first heater control button 554 and a second heater control button 558. The first heater control button 554 may be, for example a control input for the core heater array 514 (FIG. 30), while the second heater control button 558 may be, for example, a control input for the pocket heater array 518.

Figure 29:
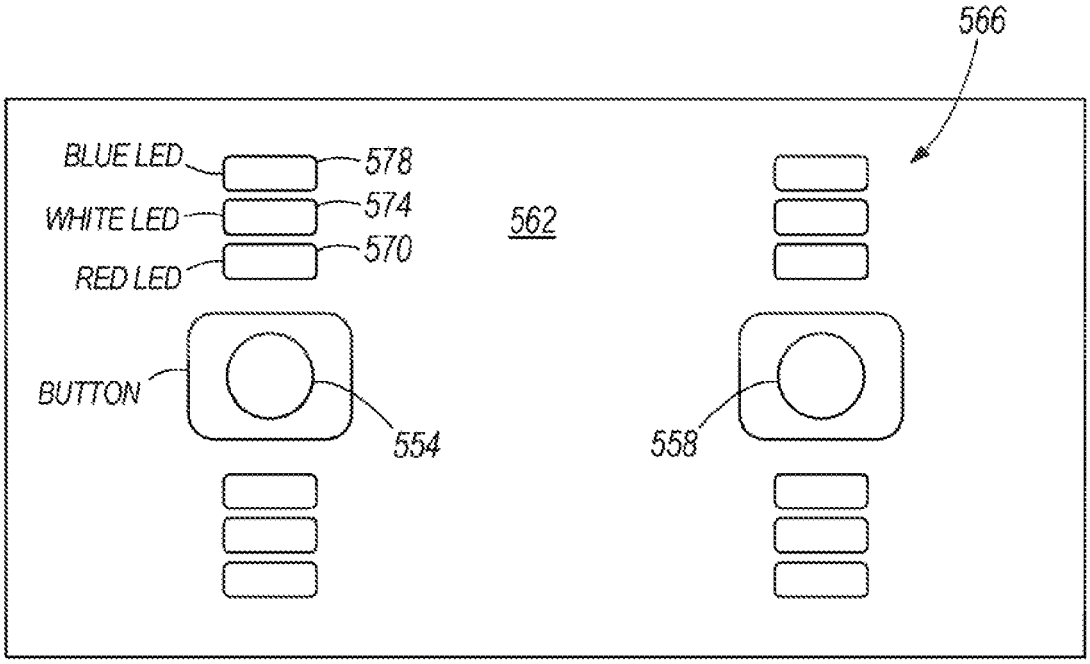
FIG. 29 is a diagram of a printed circuit board of the control input of FIG. 28.

Referring to FIG. 29, the first heater control button 554 and the second heater control button 558 are coupled to a printed circuit board (PCB) 562 of the heater control module 542. Each of the first control button 554 and the second control button 558 has an array of light emitting diodes (LEDs) 566 associate with it. More specifically, each button has associated with it a first pair of LEDs (e.g., red LEDs) 570, a second pair of LEDs (e.g., white LEDs) 574, and a third pair of LEDs (e.g., blue LEDs) 578. The LEDs 566 illuminate the external surface 550 of the heater control module 542 (FIG. 28) to provide indication of a control mode of the core heater array 514 (as selected by the first button 554) or the pocket heater array 518 (as selected by the second button 558). For example, illumination of the red LEDs 570 may indicate a high thermal output setting, illumination of the white LEDs 574 may indicate a medium thermal output setting, and illumination of the blue LEDs 578 may indicate a low thermal output setting. The heater arrays 514 and 518 are indicated as being off when no LED is illuminated.

To turn on either of the heater arrays 514 or 518, a heater control button 554 or 558, respectively, is pressed by the user and held for a period of, for example, 0.5-2.5 seconds. A temperature setting (e.g., high, medium, or low) of the core heater array 514 or pocket heater array 518 may be selected by again pressing the respective first heater control button 554 or the second heater control button 558. The heater arrays 514, 518 may be turned off by pressing and holding the respective heater control buttons 554, 558 for a period of 0.5 to 2.5 seconds.

Figure 31:
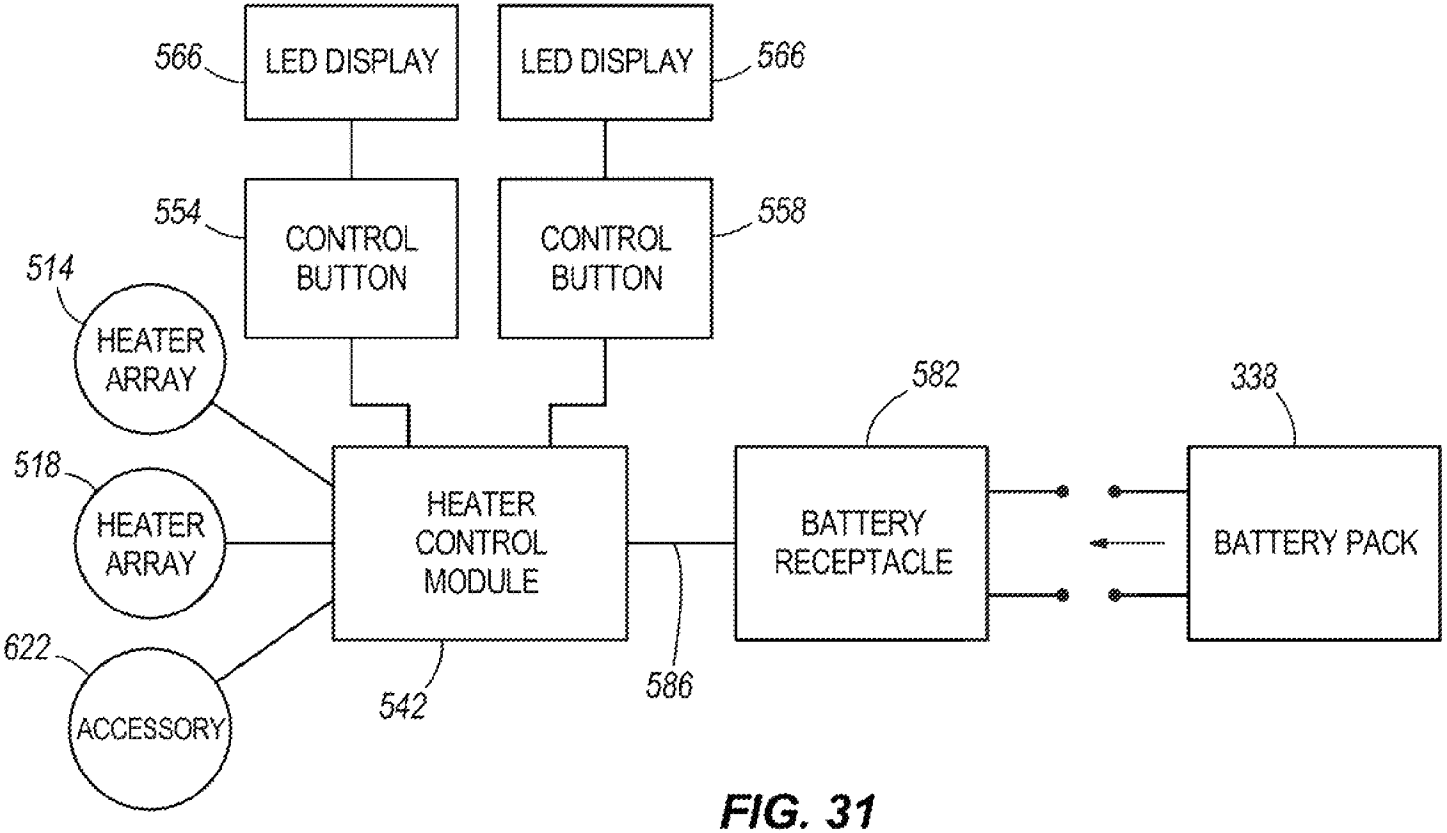
FIG. 31 is a block diagram of an alternative construction of the jacket of FIG. 27.
Figure 32:
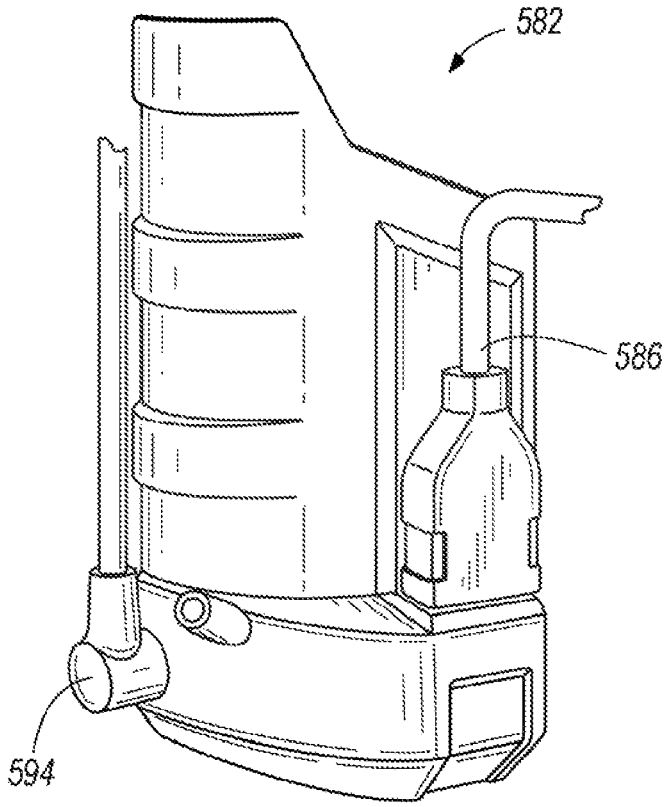
FIG. 32 is a perspective view of a battery receptacle module.
Figure 33:
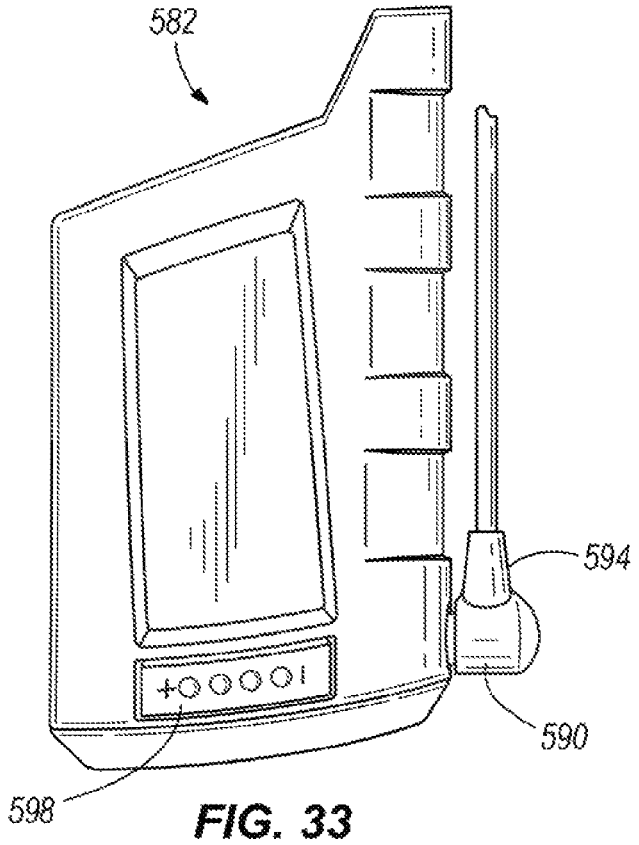
FIG. 33 is another perspective view of the battery receptacle module of FIG. 32.

FIG. 31 is an electrical block diagram of the heated jacket 488. A battery receptacle 582 (which may interchangeably be referred to as a battery holder 582) receives electricity from a battery pack (e.g., the battery pack 338 of FIG. 5) and supplies electricity to the heater control module 542 for distribution to the heater arrays 514, 518. FIG. 32 illustrates the battery receptacle 582 according to a first configuration. The battery receptacle 582 is configured to receive the 12 volt lithium-ion battery pack 338 (FIG. 18). A heater supply cable 586 from the heater control module 542 is detachably coupled the battery receptacle 582. The battery receptacle 582 also includes an accessory port 590. The accessory port 590 may be in the form of a USB outlet for receiving a USB cable 594. The USB cable may, in turn, be coupled to an accessory device such as smart phone or MP3 player. Referring to FIG. 33, the battery receptacle 582 includes a battery state-of-charge indicator 598. A state-of-charge may be indicated by the illumination of one or more LEDs.

Figure 34:
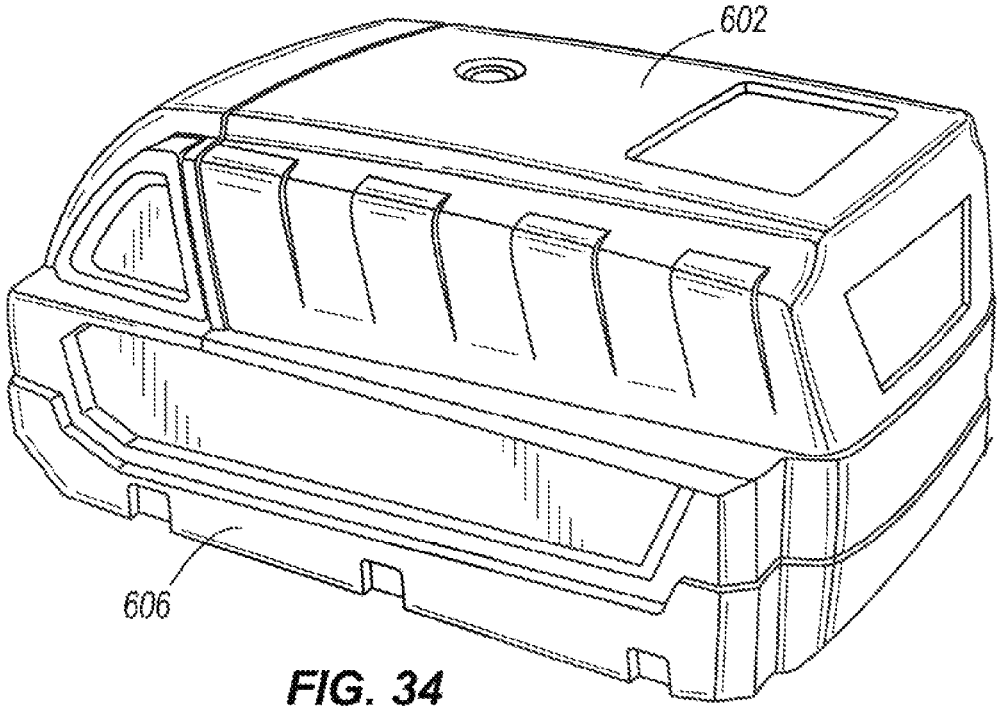
FIG. 34 is a perspective view of a battery and battery receptacle module according to another aspect of the disclosure.

FIG. 34 illustrates a battery receptacle 602 (which may interchangeably be referred to as a battery holder 602) according to another configuration. The battery receptacle 602 is configured to receive, for example, an 18 volt lithium-ion battery pack 606.

Figure 35:
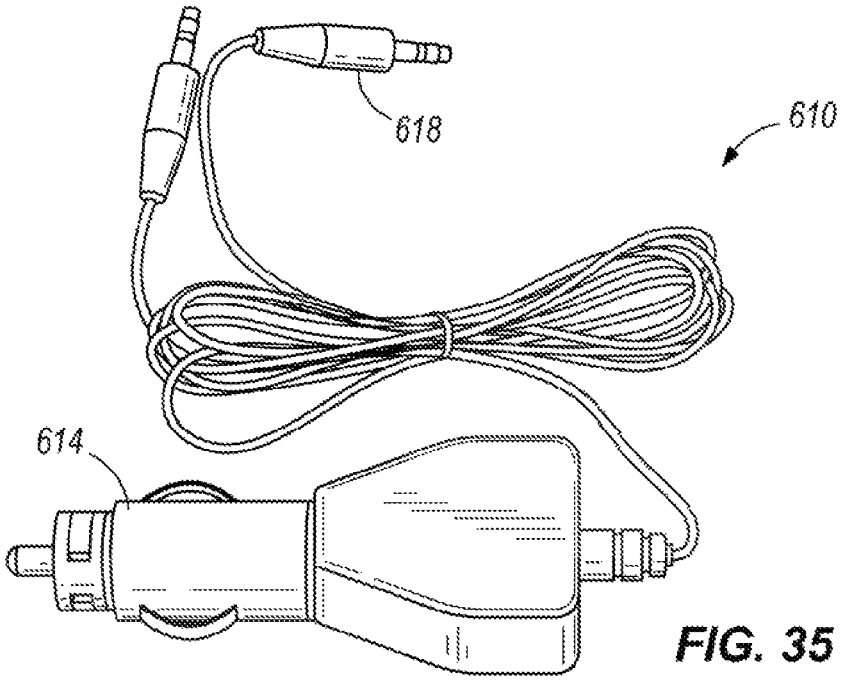
FIG. 35 illustrates a power source adapter for use with the jacket of FIG. 27.

FIG. 35 illustrates an adapter 610 that may be used with the heated jacket in place of a battery and battery receptacle. The adapter 610 includes an input plug 614 for mating with a 12V outlet cigarette lighter-type socket of a motor vehicle. An output plug 618 connects to heated jacket 488.

Referring to FIG. 31, the heater control module 542 may also interface with a heated accessory device 622. When a heated accessory device 622 is coupled to the jacket 488 and detected by the heater control module 542, the heater control module 542 deactivates the pocket heater array 518 and selectively provides power to the heated accessory device 622. The second heater control button 558 may then be used to control a thermal output setting of the accessory device 622 in a manner similar to that used to control the pocket heater array 518.

Figure 36:
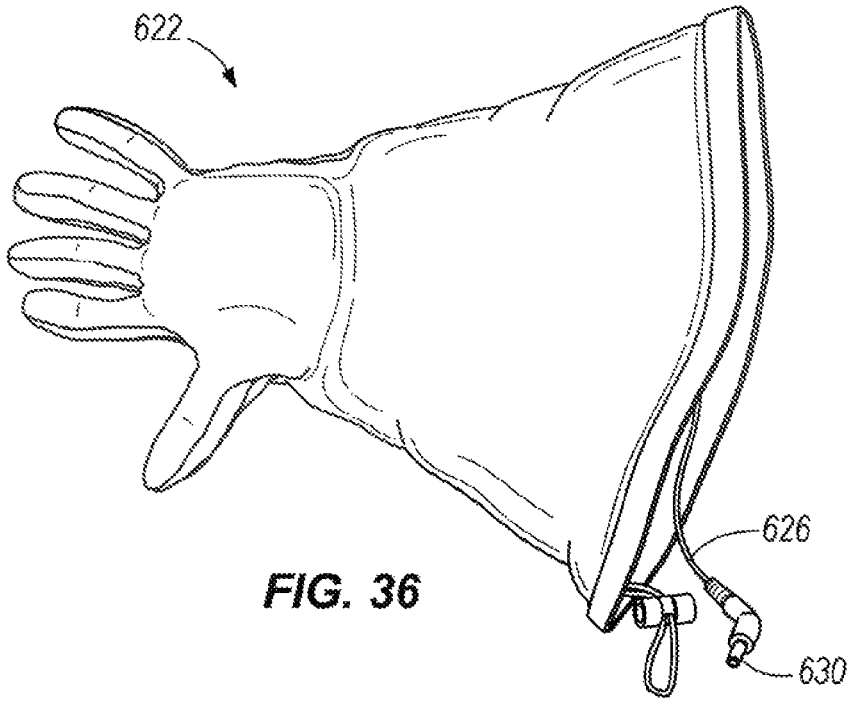
FIG. 36 illustrates an electrically heated glove coupled to an accessory port of a heated jacket.

FIG. 36 illustrates an exemplary heated accessory device 622, in the form of an electrically heated glove 622. Each glove 622 includes a resistive heating element. A power cord 626 is coupled to the heating element. The power cord 626 includes a connector 630 for connecting to the electrical system of the heated jacket 488.

Figure 37:
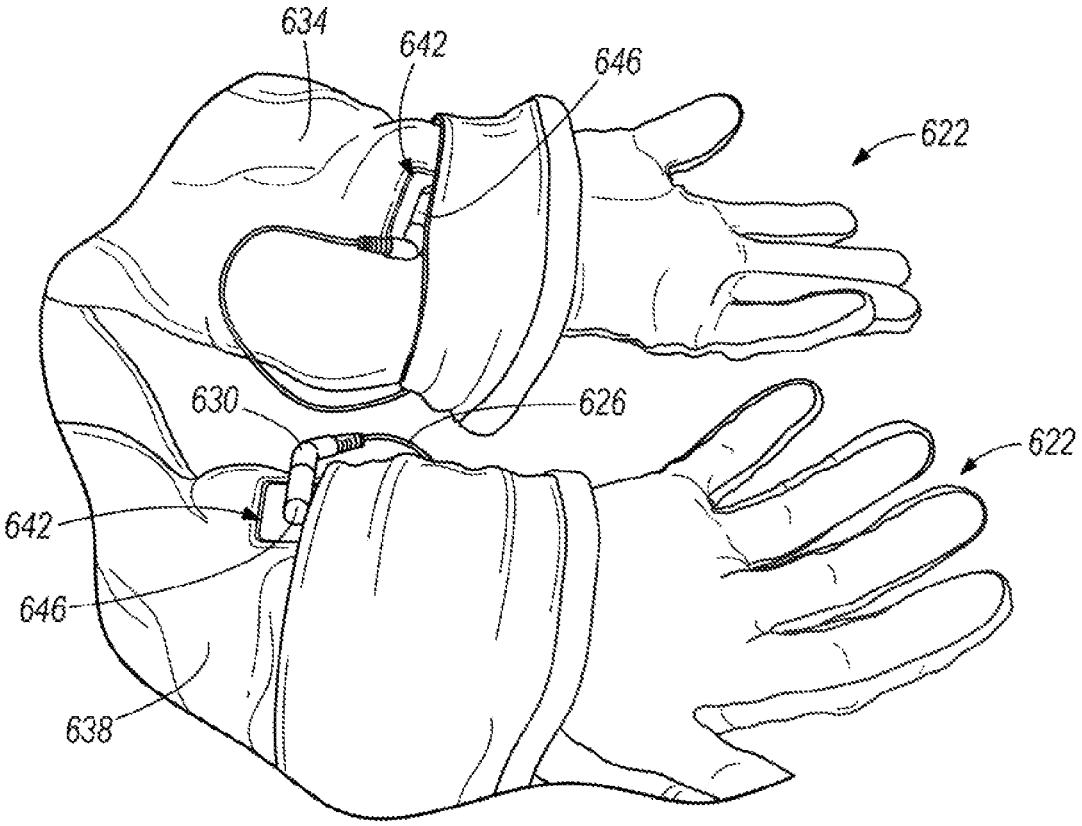
FIG. 37 illustrates the electrically heated glove of FIG. 36.

FIG. 37 illustrates the heated gloves 622 connected to a left sleeve portion 634 and a right sleeve portion 638 of a heated jacket. An accessory power port 642 is coupled to each sleeve portion 634, 638. The accessory power ports 642 include a body 646 that is coupled to an outer surface 650 of the sleeves 634, 638 by sewing, rivets, adhesives or other attachment means. The body 646 defines a power receptacle. The power receptacle is in electrical communication with the heater control module 542 (FIG. 31). Each power receptacle is configured to receive the connector 630 of the power cord 626 of a heated accessory device 322, such that the device is selectively powered by the heater control module 542.

Figure 39:
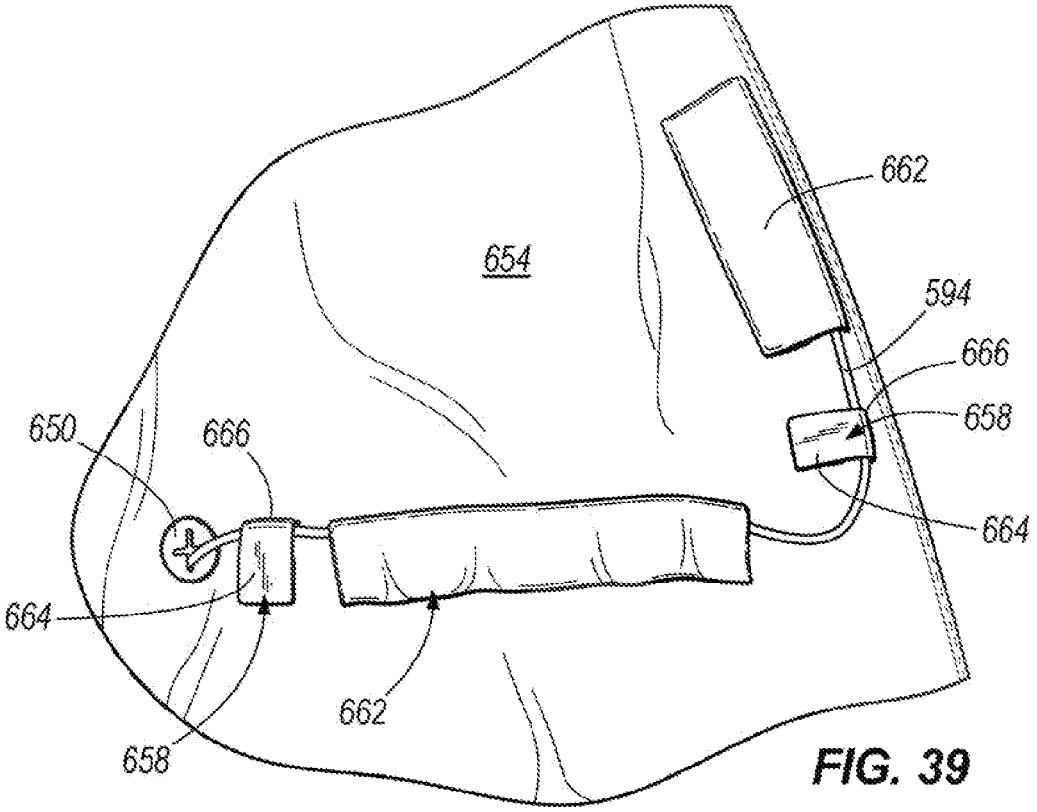
FIG. 39 illustrates wire routing features on a lining of the jacket of FIG. 27.
Figure 40:
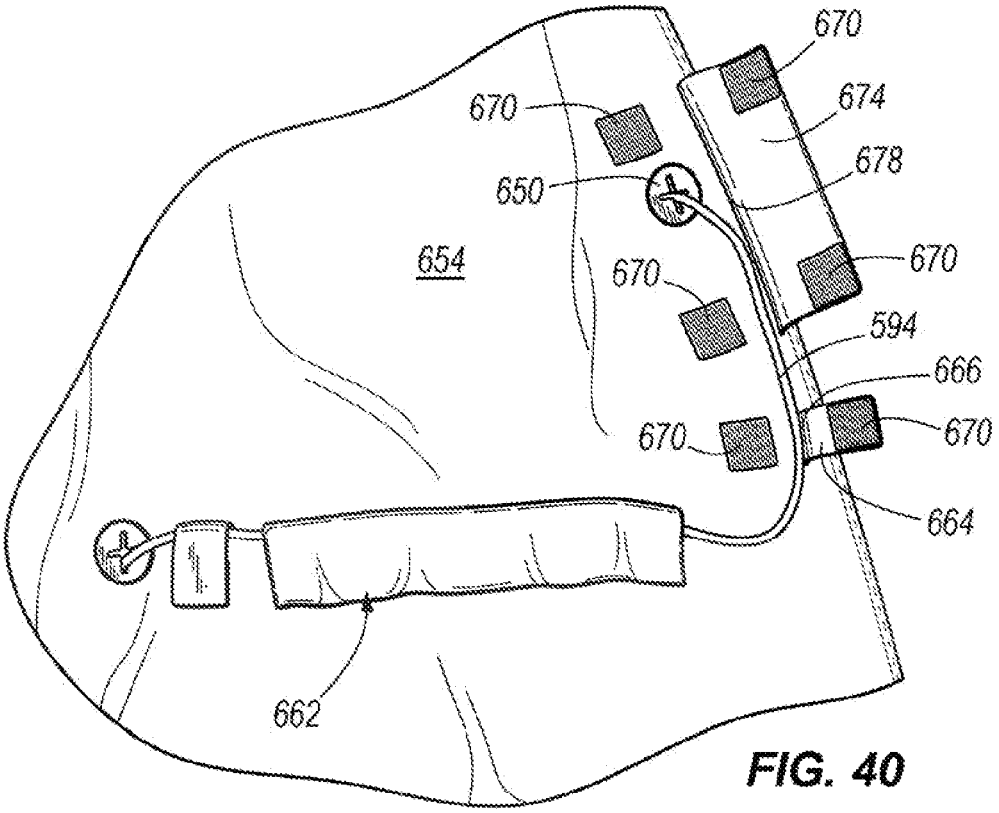
FIG. 40 also illustrates the wire routing features of FIG. 39.
Figure 41:
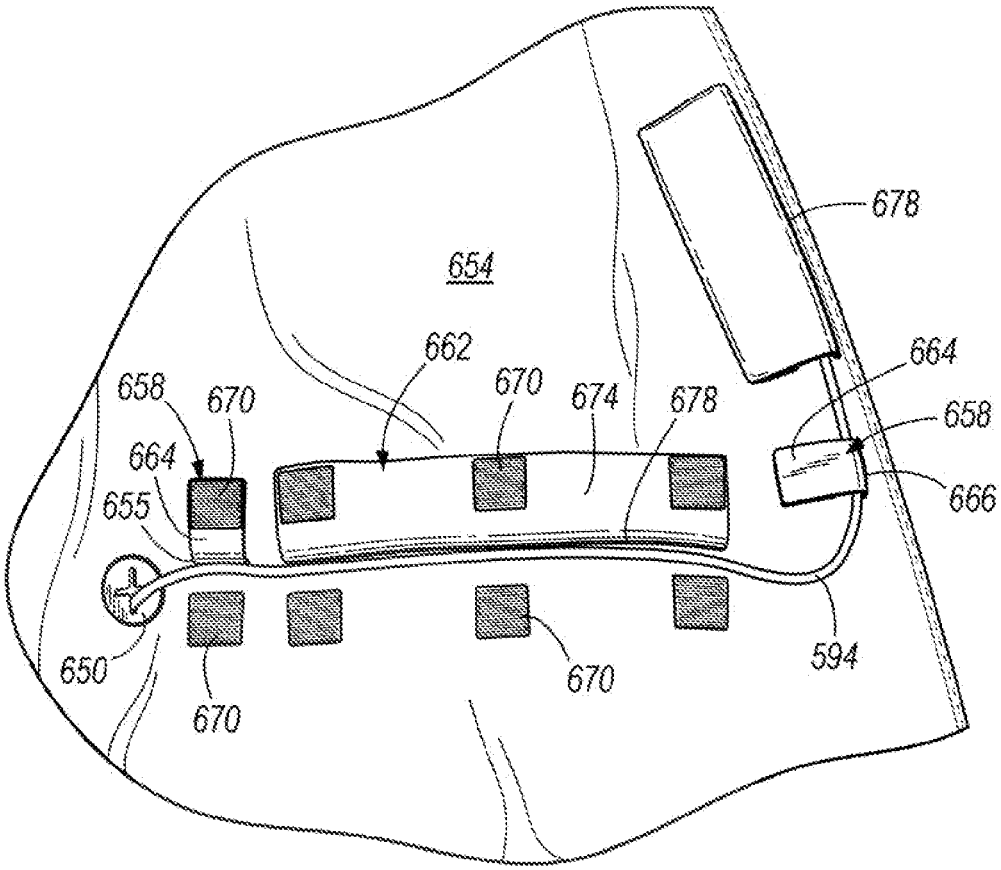
FIG. 41 also illustrates the wire routing features of FIG. 39.

FIGS. 38-41 illustrate accessory wire routing features that may be incorporated into a heated jacket, such as the heated jacket 488 of FIG. 27. Referring to FIG. 38, the rear compartment 506 may serve, for example, to hold and secure the battery receptacle 582 (FIG. 32) and battery 338 (FIG. 18). Grommets 650 are coupled to the jacket shell 492 inside the rear compartment 506. The grommets 650 surround openings through the jacket shell. FIGS. 39-41 illustrate a liner 654 of the jacket 488. The jacket 488 defines an open space between the outer shell 492 (FIG. 38) and the liner 654 (FIGS. 39-41). Grommets 650 are coupled to the liner 654 and surround openings through the liner 654. The grommets 650 facilitate the passage of accessory wires from the liner 654, through the open space, and through the outer shell 492 to the rear compartment 506. For example, a USB-type wire 594 of a device may be coupled to the accessory port 590 of a battery receptacle 582 (FIGS. 32-33) that is stored in the rear compartment (FIG. 38) 506.

Referring to FIGS. 39-41, additional wire routing features are coupled to the jacket liner 654. These additional features include wire routing tabs 658 and wire routing channels 662.

The wire routing tabs 658 include a cloth tab member 664 that is sewn to the liner 654 along a tab seam 666. Opposite the tab seam 666, hook and loop fasteners 670 are coupled to the tab members 662 and jacket liner 654, to facilitate capturing a section of wire (e.g., 594) between the liner 654 and the tab member 664.

The wire routing channels 662 include a cloth channel member 674 that is sewn to the liner 654 along a channel seam 678. Opposite the channel seam 678, hook and loop fasteners 670 are coupled to the channel member 674 and the jacket liner 654, to facilitate capturing a section of wire 594 between the liner 654 and the channel member 674. In other implementations, the hook and loop fasteners 670 of the wire routing tabs 658 and wire routing channels 662 may be replaced with buttons, snaps, or other types of fasteners.

Figure 42:
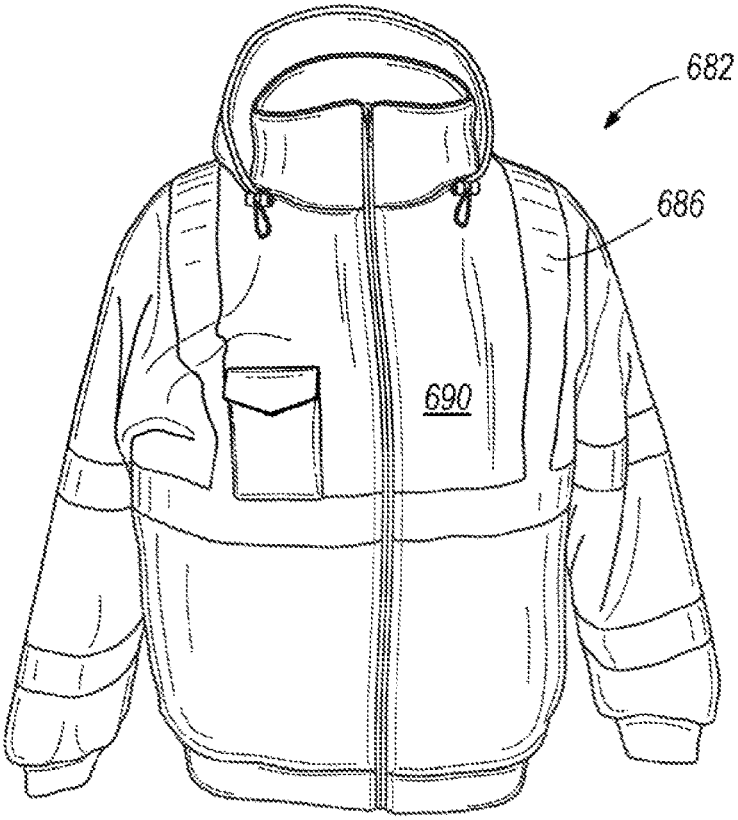
FIG. 42 illustrates a front of a jacket with visibility features.
Figure 43:
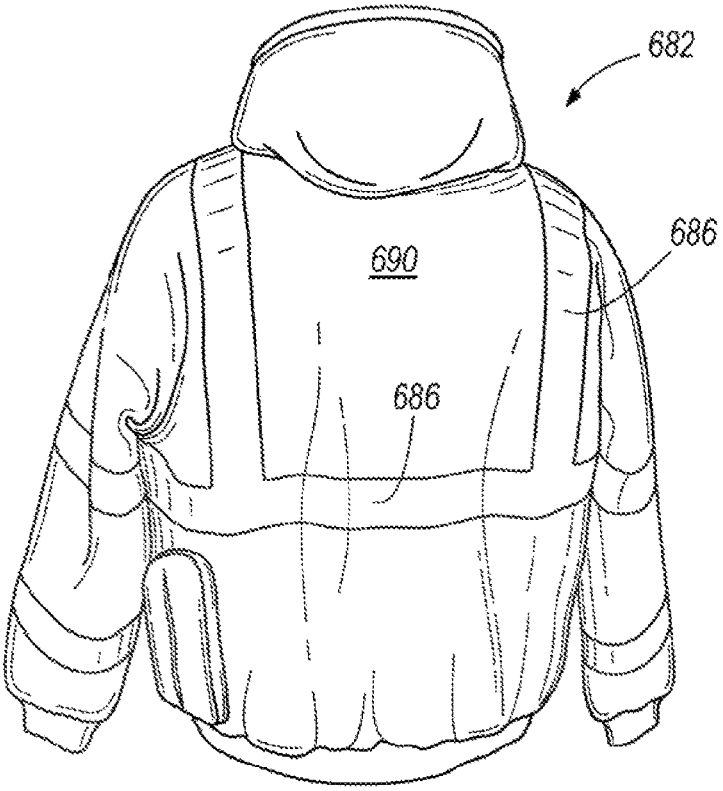
FIG. 43 illustrates a back of a jacket with visibility features.
Figure 44:
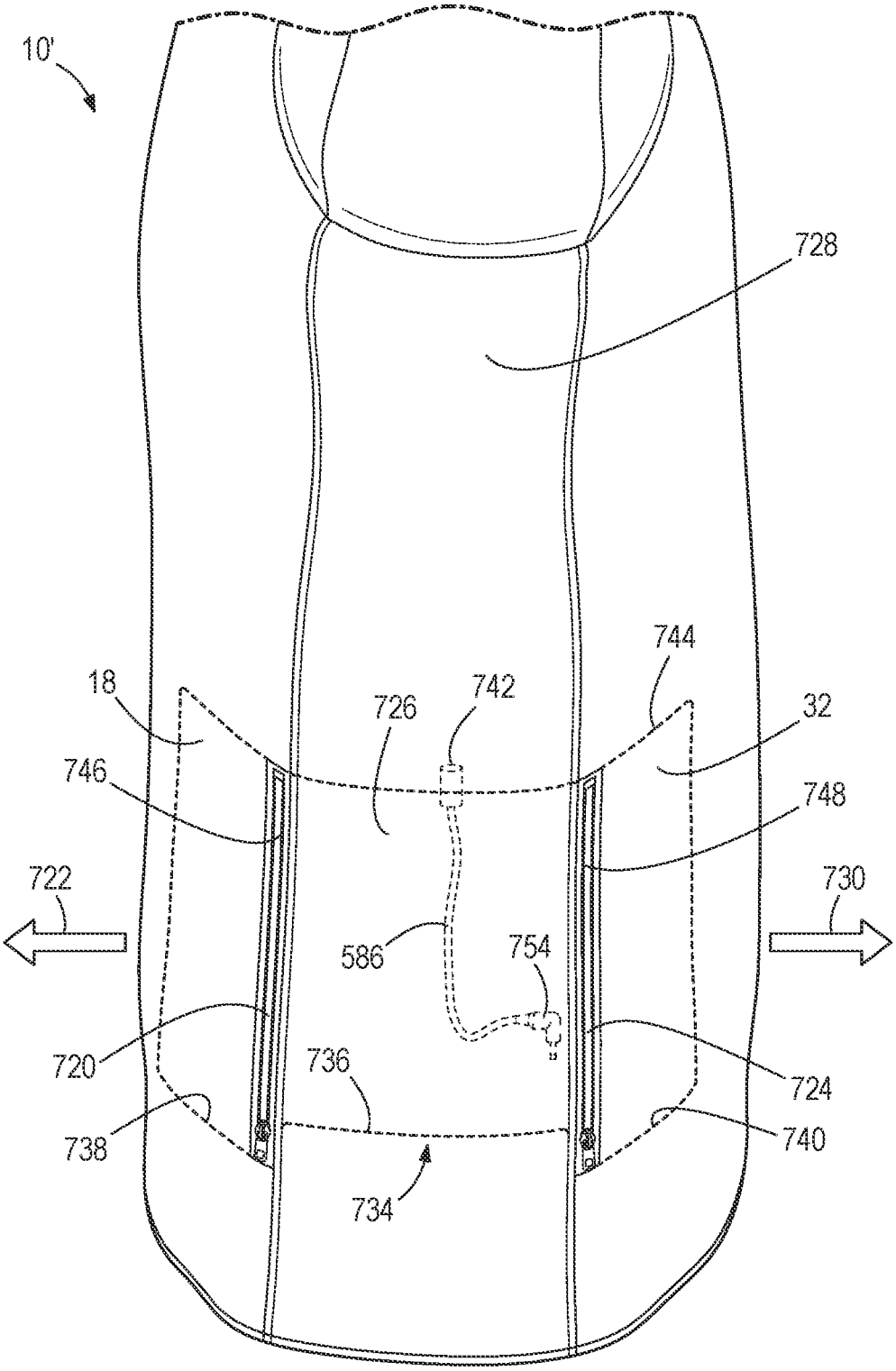
FIG. 44 is a side view of a portion of any of the jackets above according to another implementation of the disclosure.

FIGS. 42 and 43 illustrate a jacket 682 according to another implementation of the disclosure. The jacket 682 may incorporate heater and heater control features similar to those described with respect to the jacket 310 (FIG. 14) or the jacket 488 (FIG. 27), or various combinations thereof. Reflective strips 686 are coupled to an outer shell 690 of the jacket 682. The reflective strips 686 may be sewn onto the outer shell 690 of the jacket 682, or they may be adhesively bonded to the outer shell 690. In still other implementations, the reflective strips 686 may be painted onto the outer shell 690 of the jacket.

FIGS. 44-48 illustrate a garment body 10' according to any one of the implementations of the heated jacket 10, 110, 210, 310, 410, 510, 610 above, i.e., it should be understood that the garment body 10' may be employed in combination with any of the heated jackets above and with any combination of the features of the heated jackets described above.

The garment body 10' includes the pocket 18 (which may also be referred to herein as a compartment) having a pocket closure 720, such as a zipper, for selectively closing and opening the pocket 18 to the outside environment. In other implementations, the pocket closure 720 may include other suitable closure mechanisms, such as one or more buttons, snaps, toggles, ties, etc., or any combination thereof. The pocket 18 and the pocket closure 720 are disposed on a lower front 722 of the garment body 10' in the illustrated implementation (e.g., disposed in a location configured to receive the wearer's hand therein), but may be disposed on any side of the garment and in any location on the garment in other implementations (e.g., the side, the rear, etc., and towards the top, the bottom, the middle, etc.).

The garment body 10' also includes the compartment 32 disposed on a lower portion of the back torso body; however, the compartment 32 may be disposed on any side or location on the garment body 10' in other implementations. The compartment 32 is configured to house an electrical component, such as the battery pack 338 (or the battery pack of any of the implementations above) and the battery holder 582 (or the battery holder or battery receptacle according to any of the implementations above). Thus, the compartment 32 is shaped and sized to receive the battery pack 338 and the battery holder 582. The compartment 32 includes a compartment closure 724, such as a zipper or other suitable closure mechanism, providing selective access by a user to the compartment 32 in order to access the battery pack 338 and the battery holder 582.

The garment body 10' also includes a pass-through 726 disposed between the pocket 18 and the compartment 32, providing communication between the pocket 18 and the compartment 32. The pass-through 726 is a passage disposed between outer and inner layers of a side panel 728 of the garment body 10', and between the front 722 and a rear 730 (which may also be referred to herein as the back). The pass-through 726 is internal to the garment body, between inner and outer layers. The sides of the garment body 10' generally correspond with the front, rear, and sides of the wearer's body when wearing the garment body 10'. The pocket 18 is generally disposed on the front 722 and the compartment 32 is generally disposed on the rear 730. A wall 734 is disposed between the pocket 18 and the compartment 32, in the side panel 728, for inhibiting the unwanted movement of objects between the pocket 18 and the compartment 32. The wall 734 defines a floor 736 of the pass-through 726. In the illustrated implementation, the floor 736 is higher than a floor 738 of the pocket 18 and a floor 740 of the compartment 32. High and low are defined herein relative to a wearer's body, with higher being closer to the wearer's head and lower being closer to the wearer's feet. Thus, the wall 734 provides a partial barrier, or constriction, or narrowing, between the pocket 18 and the compartment 32. In other implementations, the floor 736 may be at relatively the same height as the floor 738 and the floor 740. Alternatively, the floors 738, 740 may be at different heights such that the floor 736 is at the same height as one of the floors 738, 740, but higher than the other floor 738, 740. The wall 734 may be formed from stitching, such as topstitching or other suitable stitching types, or from any other suitable form of fastening, such as glue, adhesive, hook-and-loop fastener, etc.

The pocket 18 also is configured to alternatively house the battery pack 338 (or the battery pack of any of the implementations above) and the battery holder 582 (or the battery holder or battery receptacle according to any of the implementations above). Thus, the pocket 18 is also sized and shaped to receive the battery pack 338 and the battery holder 582. The pocket closure 720 provides selective access by a user to the compartment 32 in order to access the battery pack 338 and the battery holder 582.

The pass-through 726 is sized and shaped to allow the battery pack 338 and the battery holder 582 to pass between the pocket 18 and the compartment 32 while the battery pack 338 and the battery holder 582 are coupled to each other. The wearer may move the battery pack 338 and the battery holder 582 between the pocket 18 and the compartment 32 by way of the pass-through 726, depending upon the wearer's preference.

The garment body 10' also includes the heater supply cable 586, or a heater supply cable in accordance with any of the implementations above. The heater supply cable 586 is configured to electrically and mechanically couple to the battery holder 582, e.g., by way of a barrel plug 754 and port connection, or any other type of connection in other implementations. The barrel plug 754 is disposed at a distal end of the heater supply cable 586 in the illustrated implementation. In other implementations, the distal end of the heater supply cable 586 may include the port and the battery holder 582 may include the barrel plug. In still other implementations, the barrel plug 754 may be omitted, and the heater supply cable 586 may be non-removably coupled to the battery holder 582. The heater supply cable 586 provides electrical power from the battery pack 338 to the heating system 510. In other implementations, the heating system 510 may be in accordance with any of the implementations of a heating system, a heater, or a heater array described above. The heater supply cable 586 extends through a heater supply aperture 742 (e.g., a button hole, a grommet, or the like) in the pass-through 726. In other implementations, the heater supply aperture 742 may be disposed in the pocket 18 or in the compartment 32.

Figure 45:
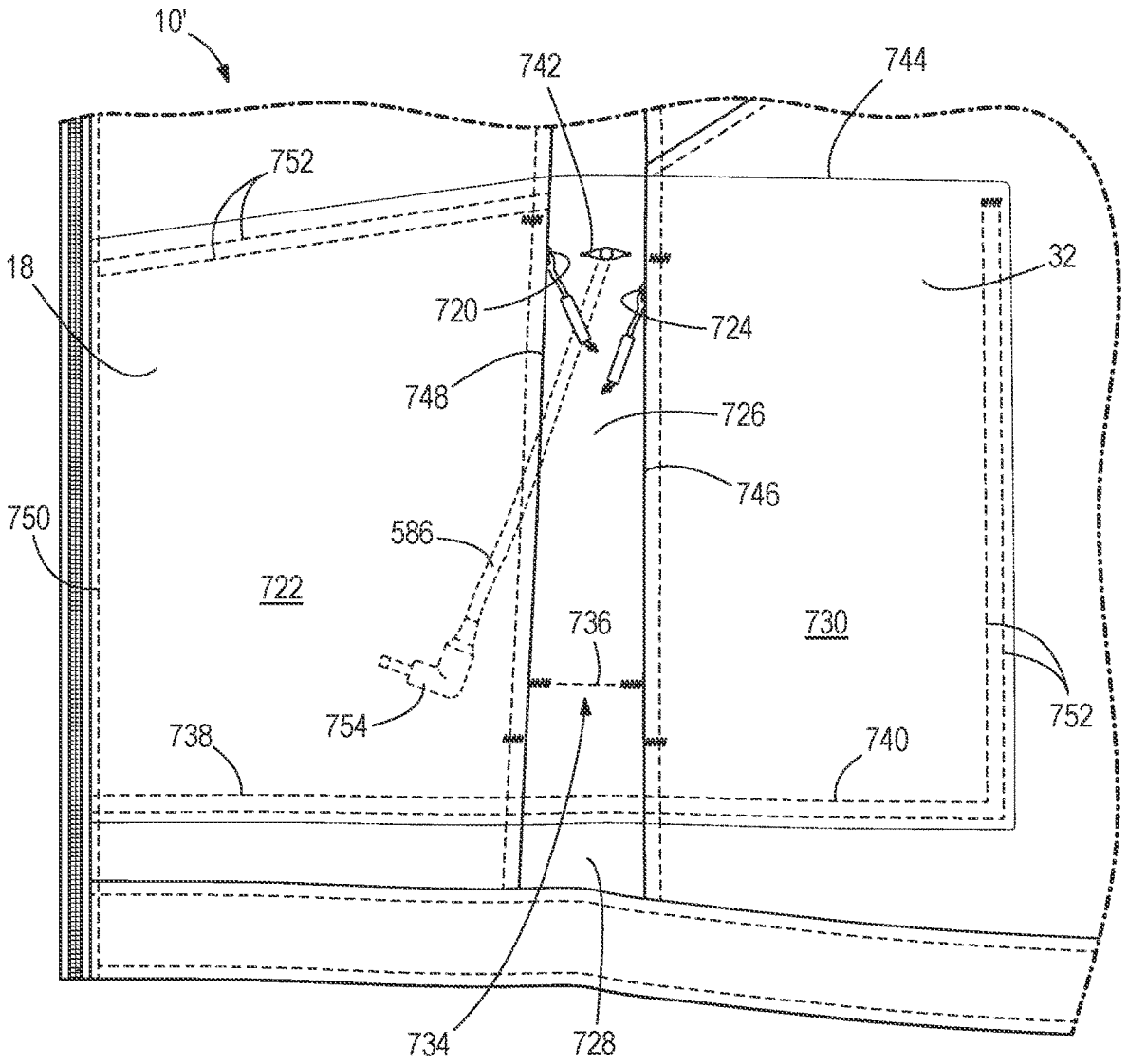
FIG. 45 illustrates a pocket bag construction for the jacket of FIG. 44.

The pocket 18, the compartment 32, and the pass-through 726 are collectively formed from a pocket bag 744, as best illustrated in FIG. 45. In the illustrated implementation, the pocket bag 744 includes one piece behind the main shell (such as the outer shell 492 described above, or any other implementation of a shell described herein). The pocket bag 744 may include a tube of material, and the ends of the tube may be fastened closed. The pocket bag 744 may include a first slit 746 corresponding with the pocket closure 720 and a second slit 748 corresponding with the compartment closure 724. The pocket bag 744 defines the pocket 18, the compartment 32, and the pass-through 726. The heater supply aperture 742 is formed in the pocket bag 744. In other implementations, the pocket bag 744 may be formed from multiple pieces of material fastened to each other in any suitable fashion. The pocket bag 744 may be attached in a center front 750 of the garment body 10' and along topstitching 752, though in other implementations the pocket bag 744 may be attached in other locations. The wall 734 may be formed by fastening the pocket bag 744 to the main shell 492 of the garment body 10', e.g. by way of the topstitching 752 or other suitable stitching or fastening mechanisms.

In the illustrated implementation, the pocket closure 720 and the compartment closure 724 are disposed on opposite sides of the pass-through 726. The pocket closure 720 is disposed at a junction of the pass-through 726 and the pocket 18 where the narrowing of the pass-through 726 expands to the pocket 18. The compartment closure 724 is disposed at a junction of the pass-through 726 and the compartment 32 where the narrowing of the pass-through 726 expands to the compartment 32. In other implementations, the pocket closure 720 and the compartment closure 724 may be disposed in other areas of the pocket 18 and the compartment 32, respectively.

Figures 46, 47, 48:
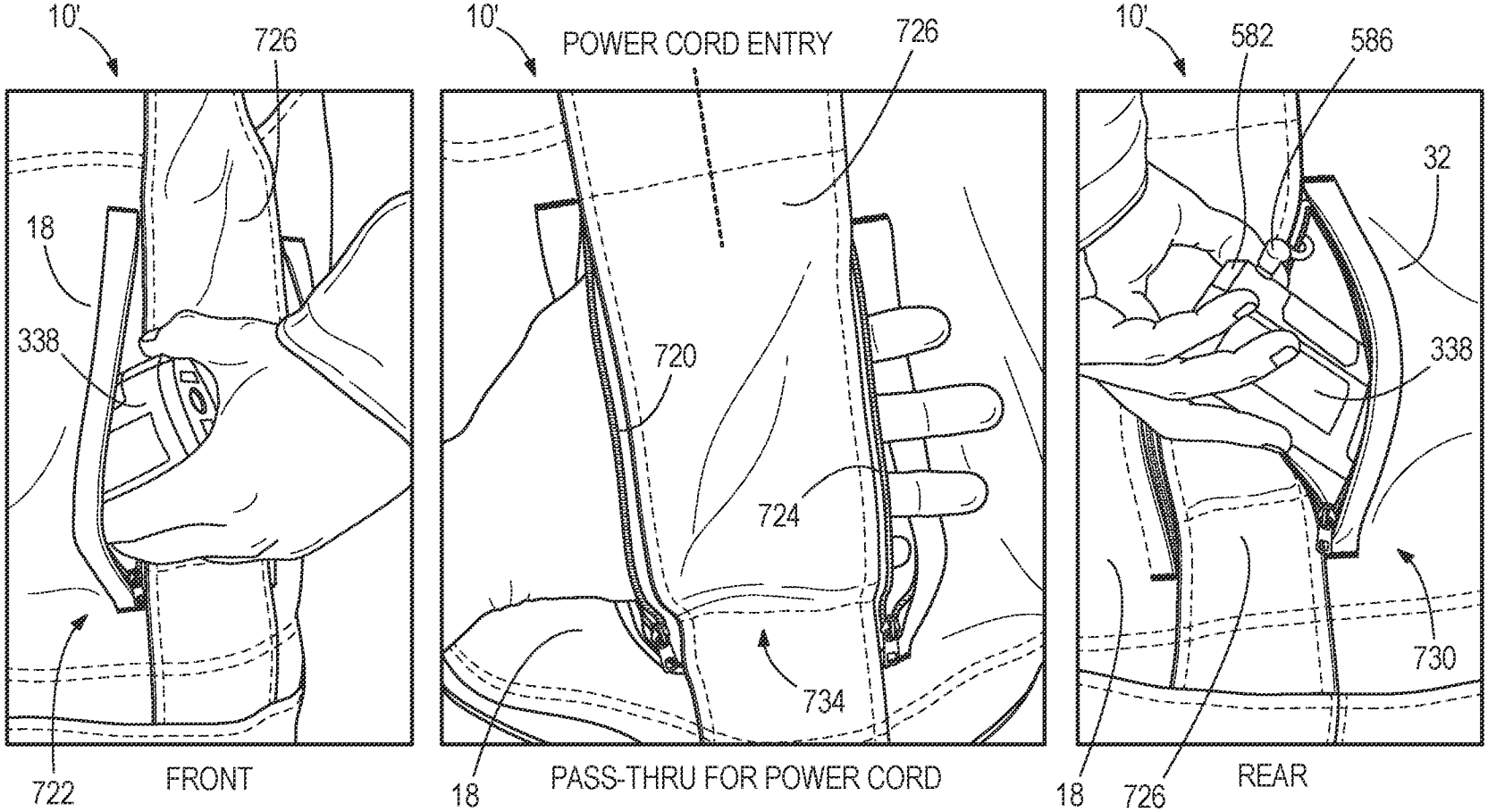
FIG. 46 illustrates a wearer placing electrical components in a pocket of the jacket of FIG. 44.
FIG. 47 illustrates a wearer's hand in a pass-through in the jacket of FIG. 44.
FIG. 48 illustrates a wearer placing electrical components in a compartment of the jacket of FIG. 44.

FIGS. 46-48 illustrate a wearer employing the pass-through 726 (FIG. 47) to move the battery pack 338 and the battery holder 582 between the pocket 18 (FIG. 46) and the compartment 32 (FIG. 48). The heater supply cable, and specifically the barrel plug 754, is movable between a first position and a second position. The barrel plug 754 is disposed in the first compartment in the first position and in the second compartment in the second position. The barrel plug 754 may also be disposed in the pass-through 726 in a third position, e.g., during the transition between the pocket 18 and the compartment 32, between the first and second positions.

In other implementations, the pass-through 726 may be formed between any two or more pockets and/or compartments in any type of garment, such as jackets, vests, sweatshirts, hoodies, sweaters, pullovers, coats, gloves, pants, undergarments, etc. The terms pocket and compartment are used interchangeably herein.

In yet other implementations, the garment body 10' may include a single pocket closure 720 such that there is no compartment closure 724, or vice versa. The single pocket closure 720 provides access to the pocket 18 directly and to the compartment 32 indirectly by way of the pass-through 726 (or vice versa). In such implementations, the pocket bag 744 may include the first slit 746 corresponding with the pocket closure 720 and not the second slit 748 corresponding with the compartment closure 724 (as there would be no compartment closure 724), or vice versa.

In operation, the wearer may connect the battery pack 338 to the battery holder 582 and then connect the battery holder 582 to the heater supply cable 586. The wearer may pull the heater supply cable 586 (and more specifically the barrel plug 754) out either one of the pocket 18 or the compartment 32 in order to make the connection to the battery holder 582. The wearer may also make the connection within either one of the pocket 18 or the compartment 32. The wearer may move the connected battery pack 338 and battery holder 582 between the pocket 18 and the compartment 32 by way of the pass-through 726 without having to disconnect and reconnect the heater supply cable 586 from the battery holder 582. The wall 734 constricts the pass-through 726 to inhibit unintentional movement of the battery pack 338 and battery holder 582 (as well as other items (e.g., keys, cellphone, coins, etc.)) between the pocket 18 and the compartment 32.

Thus, the disclosure provides, among other things, an electrically heated garment with a pass-through battery pocket. Although the disclosure has been described in detail with reference to certain preferred implementations, variations and modifications exist within the scope and spirit of one or more independent aspects of the disclosure as described.

What is claimed is:

1. A heated article of clothing comprising:
a garment body;
a heater coupled to the garment body;
a heater supply cable configured to provide electrical power to the heater;
a battery pack configured to power to the heater; and
a battery holder electrically and mechanically coupleable with the battery pack and configured to provide the power from the battery pack to the heater by way of the heater supply cable;
wherein the garment body includes:
a first compartment disposed at least partially in a front of the garment body and configured to hold the battery pack and the battery holder,
a second compartment disposed at least partially in a rear of the garment body and configured to alternatively hold the battery pack and the battery holder, and
a pass-through connecting the first compartment to the second compartment internally within the garment body such that the battery pack is movable internally between the front and rear of the garment body while remaining coupled with the heater supply cable.

2. The heated article of clothing of claim 1, wherein the pass-through includes a narrowing between the first and second compartments configured to inhibit unwanted movement of the battery pack and the battery holder between the first and second compartments and sized and shaped to allow a user to pass the battery pack and the battery holder between the first and second compartments.

3. A heated article of clothing comprising:
a garment body;
a heater coupled to the garment body;
a heater supply cable configured to provide electrical power to the heater; and
a battery pack configured to power to the heater by way of the heater supply cable;
wherein the garment body includes:
a first compartment configured to hold the battery pack,
a second compartment configured to alternatively hold the battery pack, and
a pass-through connecting the first compartment to the second compartment internally within the garment body such that the battery pack is movable between the first and second compartments while remaining coupled with the heater supply cable.

4. The heated article of clothing of claim 3, wherein the pass-through includes a narrowing between the first and second compartments.

5. The heated article of clothing of claim 3, wherein a floor of the pass-through is higher than a floor of the first and second compartments to provide a constriction between the first and second compartments.

6. The heated article of clothing of claim 3, wherein the first compartment is disposed in a front portion of the garment body and the second compartment is disposed in a rear portion of the garment body such that the battery pack is movable between the front and rear portions of the garment body while remaining coupled with the heater supply cable.

7. The heated article of clothing of claim 3, further comprising a battery holder configured to electrically and mechanically couple with the battery pack.

8. The heated article of clothing of claim 7, wherein the battery holder includes an electrical port that is electrically connectable with the heater supply cable for providing electrical power from the battery pack to the heater.

9. The heated article of clothing of claim 7, wherein the pass-through is sized and shaped to allow the battery pack and the battery holder to pass between the first and second compartments while the battery pack and the battery holder are coupled to each other.

10. The heated article of clothing of claim 3, wherein the heater supply cable extends through a heater supply aperture in the garment body, and wherein the heater supply aperture is disposed in one of the pass-through, the first compartment, or the second compartment.

11. The heated article of clothing of claim 10, wherein heater supply aperture is disposed in the pass-through.

12. A heated article of clothing comprising:
a garment body;
a heater coupled to the garment body;
a heater supply cable configured to provide electrical power to the heater; and
a battery pack configured to power to the heater by way of the heater supply cable;
wherein the garment body includes:
a first compartment configured to hold the battery pack, and
a second compartment in communication with the first compartment and configured to alternatively hold the battery pack such that the battery pack is movable internally within the garment body between the first and second compartments while remaining coupled with the heater supply cable.

13. The heated article of clothing of claim 12, further comprising a constriction between the first and second compartments configured to inhibit unwanted movement of the battery pack between the first and second compartments and sized and shaped to allow a user to pass the battery pack between the first and second compartments.

14. The heated article of clothing of claim 13, wherein a floor of the constriction is higher than a floor of the first and second compartments.

15. The heated article of clothing of claim 12, wherein the first compartment is disposed in a front portion of the garment body and the second compartment is disposed in a rear portion of the garment body such that the battery pack is movable between the front and rear portions of the garment body while remaining coupled with the heater supply cable.

16. The heated article of clothing of claim 12, further comprising a battery holder configured to electrically and mechanically couple with the battery pack.

17. The heated article of clothing of claim 16, wherein the battery holder includes an electrical port that is electrically connectable with the heater supply cable for providing electrical power from the battery pack to the heater.

18. The heated article of clothing of claim 16, wherein a pass-through providing the communication between the first and second compartments is sized and shaped to allow the battery pack and the battery holder to pass between the first and second compartments while the battery pack and the battery holder are coupled to each other.

19. The heated article of clothing of claim 12, wherein the heater supply cable extends through a heater supply aperture in the garment body, and wherein the heater supply aperture is disposed in one of the first compartment, the second compartment, or a pass-through providing the communication between the first and second compartments.

20. The heated article of clothing of claim 12, wherein the heater supply cable extends through a heater supply aperture in the garment body, and wherein the heater supply aperture is disposed in a pass-through providing the communication between the first and second compartments.

21. A heated article of clothing comprising:

a garment body;

a heater coupled to the garment body;

a heater supply cable configured to provide electrical power to the heater; and a battery pack configured to power to the heater by way of the heater supply cable;

wherein the garment body includes:

a first compartment configured to hold the battery pack, and a second compartment in communication with the first compartment and configured to alternatively hold the battery pack such that the battery pack is movable between the first and second compartments while remaining coupled with the heater supply cable, wherein the first compartment is disposed at least partially in a front portion of the garment body and the second compartment is disposed at least partially in a rear portion of the garment body such that the battery pack is movable between the front and rear portions of the garment body while remaining coupled with the heater supply cable.

22. The heated article of clothing of claim 21, further comprising a pass-through connecting the first compartment to the second compartment internally within the garment body, wherein the pass-through includes a narrowing between the first and second compartments.

23. A heated article of clothing comprising:

a garment body;

a heater coupled to the garment body; and a heater supply cable configured to provide electrical power to the heater;

wherein the garment body includes:

a first compartment configured to hold a battery pack configured to power to the heater by way of the heater supply cable, and a second compartment in communication with the first compartment and configured to alternatively hold the battery pack such that the battery pack is movable internally within the garment body between the first and second compartments while remaining coupled with the heater supply cable.

24. The heated article of clothing of claim 23, wherein the heater supply cable is configured to extend through the garment body and into the first compartment and/or the second compartment.

25. The heated article of clothing of claim 23, wherein the first compartment is disposed at least partially in a front portion of the garment body and the second compartment is disposed at least partially in a rear portion of the garment body.

26. The heated article of clothing of claim 23, further comprising a pass-through connecting the first compartment to the second compartment internally within the garment body, wherein the pass-through includes a narrowing between the first and second compartments.

* * * * *